US009490574B2

(12) United States Patent
Kon et al.

(10) Patent No.: US 9,490,574 B2
(45) Date of Patent: Nov. 8, 2016

(54) CONNECTOR WITH DETECTING MEMBER

(71) Applicant: SUMITOMO WIRING SYSTEMS, LTD., Yokkaichi, Mie (JP)

(72) Inventors: Akihiro Kon, Yokkaichi (JP); Yutaka Noro, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 14/035,259

(22) Filed: Sep. 24, 2013

(65) Prior Publication Data

US 2014/0134867 A1 May 15, 2014

(30) Foreign Application Priority Data

Nov. 14, 2012 (JP) ..... 2012-250609

(51) Int. Cl.
*H01R 13/639* (2006.01)
*H01R 13/627* (2006.01)
*H01R 13/641* (2006.01)

(52) U.S. Cl.
CPC ..... *H01R 13/627* (2013.01); *H01R 13/6272* (2013.01); *H01R 13/639* (2013.01); *H01R 13/641* (2013.01)

(58) Field of Classification Search
CPC ..... H01R 13/62–13/64
USPC ..... 439/352, 345, 489
See application file for complete search history.

(56) References Cited

U.S. PATENT DOCUMENTS

| | | | | |
|---|---|---|---|---|
| 6,261,116 | B1 * | 7/2001 | Ceru | 439/352 |
| 7,909,638 | B2 * | 3/2011 | Seo et al. | 439/489 |
| 2004/0023547 | A1 | 2/2004 | Oka | |
| 2004/0067676 | A1 | 4/2004 | Nimura | |
| 2006/0170429 | A1 * | 8/2006 | Nakamura et al. | 324/538 |
| 2009/0035981 | A1 | 2/2009 | Lim | |

FOREIGN PATENT DOCUMENTS

| | | | |
|---|---|---|---|
| DE | 10333076 | A1 | 3/2004 |
| WO | WO 2009/047744 | A2 | 4/2009 |

OTHER PUBLICATIONS

Feb. 17, 2014 Extended European Search Report issued in European Application No. 13189635.9.

* cited by examiner

*Primary Examiner* — Felix O Figueroa
*Assistant Examiner* — Paul Baillargeon
(74) *Attorney, Agent, or Firm* — Oliff PLC

(57) ABSTRACT

A connector includes: (i) a lock arm that extends rearwardly in a cantilevered shape from a housing main body, and (ii) a detecting member arranged to be movable forward from an initial position to a detecting position. The detecting member includes (i) an elastic arm portion extending in a cantilever shape diagonally upward and forward; (ii) an abutting portion at an extended end portion of the elastic arm portion and restricting movement of the detecting member from the initial position to the detecting position; (iii) a pair of walls, one at the left and one at the right, raised from the top surface of the housing main body; (iv) a bridge portion connecting top ends of the walls; and (v) an excessive bending restriction portion restricting excessive bending of the lock arm upward by covering the top surface of the lock arm with the bridge portion.

4 Claims, 21 Drawing Sheets

CONNECTOR WITH DETECTING MEMBER

BACKGROUND

Some embodiments relate to a connector.

Japanese Published Patent Application 2004-103551 (P2004-103551A) discloses a related art connector including: (i) a housing main body that is engageable to a counterpart housing, (ii) a lock arm that extends rearwardly in a cantilevered state from a top surface of the housing main body, and that holds the housing main body and the counterpart housing in a normal engagement state by virtue of being elastically engaged to a lock receiver of the counterpart housing, and (iii) a detecting member that is assembled to the housing main body and that is movable between an initial position and a detecting position that is forward of the initial position.

An elastic arm portion is formed on the detecting member, which extends in a cantilevered state diagonally upward and forward, and the detecting member is held at an initial position as an extended end of the elastic arm portion is engaged to the lock arm from behind. When the housing main body is engaged to the counterpart housing, engagement of the elastic arm portion is released, and the detecting member can be moved from the initial position to the detecting position. Based on whether the detecting member can be moved to the detecting position, it can be detected whether the housing main body and the counterpart housing have been engaged.

A certain movement may occur if the housing main body is not engaged to the counterpart housing, and if the detecting member at an initial state is forcibly pushed to a detecting position side. Specifically, the elastic arm portion pushes up the lock arm, while the elastic arm portion slips under the lock arm, the detecting member may incorrectly move forward to the detecting position side. However, a pressing portion formed on the housing main body presses down an extended end portion of the lock arm, so that pushing up of the lock arm is restricted, and it is possible to suppress the detecting member from incorrectly moving forward to a detecting position.

SUMMARY

However, the pressing portion of the connector extends in a cantilevered state from a top end of a wall that is raised from the housing main body. Because of this, when a force to push up the lock arm is strong, the pressing portion is urged and deformed upward, and an operation to push up the lock arm cannot be suppressed. If the pushing up of the lock arm cannot be restricted, the detecting member incorrectly moves to the detecting position before the housing main body is engaged to the counterpart housing. As a result, the detecting member cannot detect engagement.

Some of the disclosed embodiments address the above-mentioned situation, and thus enhance reliability of a detecting member's operation of detecting engagement.

Some embodiments are therefore directed to a connector that includes:

- a counterpart housing having a lock receiver;
- a housing main body that is engageable to the counterpart housing;
- a lock arm that extends rearwardly in a cantilevered state from a top surface of the housing main body, can be bent and deformed in a vertical direction crossing a direction of engagement of the housing main body and the counterpart housing, and holds the housing main body and the counterpart housing in a normal engagement state by virtue of being elastically engaged to the lock receiver;
- a detecting member that is assembled to the top surface of the housing main body and is moved from an initial position to a detecting position if the housing main body and the counterpart housing are engaged to each other;
- an elastic arm portion that is formed on the detecting member, extends in a cantilevered state diagonally upward and forward, and can be bent and deformed in a vertical direction;
- an abutting portion that is formed at an extended end portion of the elastic arm portion, restricts the movement of the detecting member from the initial position to the detecting position by engaging the lock arm from behind, and releases engagement of the lock arm if the housing main body and the counterpart housing are engaged to each other;
- a contact portion that is formed at the extended end portion of the elastic arm portion, and restricts the contact portion from slipping off upward from engagement of the lock arm by contacting the lock arm from below; and
- an excessive bending restriction portion that includes: (i) a pair of walls, one at the left and one at the right, the walls being raised from the top surface of the housing main body, and (ii) a bridge portion that connects top ends of the walls, and restricts excessive bending of the lock arm upward by covering the top surface of the lock arm with the bridge portion.

In accordance with the above connector, in a state in which the detecting member is at an initial position, the abutting portion of the elastic arm portion is engaged to the lock arm from behind, and a contact portion contacts the lock arm from below. Because of this configuration, if the detecting member at the initial position is pushed forward toward a detecting position, the elastic arm portion pushes up the lock arm, and the detecting member may be incorrectly pushed to the detecting position side. However, in this embodiment, a top surface of the lock arm is covered with a bridge portion, so that the lock arm can be suppressed or impeded from being incorrectly pushed up.

Additionally, both the right and left end portions of the bridge portion are supported by a pair of walls that are raised from the housing main body, so they do not succumb to a pressure force from the lock arm side and become deformed. According to this embodiment, pushing up of the lock arm can be reliably restricted, and it is possible to reliably suppress or impede the detecting member from being incorrectly moved to a detecting position. Thus, reliability of a detecting member's operation of detecting engagement is enhanced or excellent.

DETAILED DESCRIPTION

Figure 1:
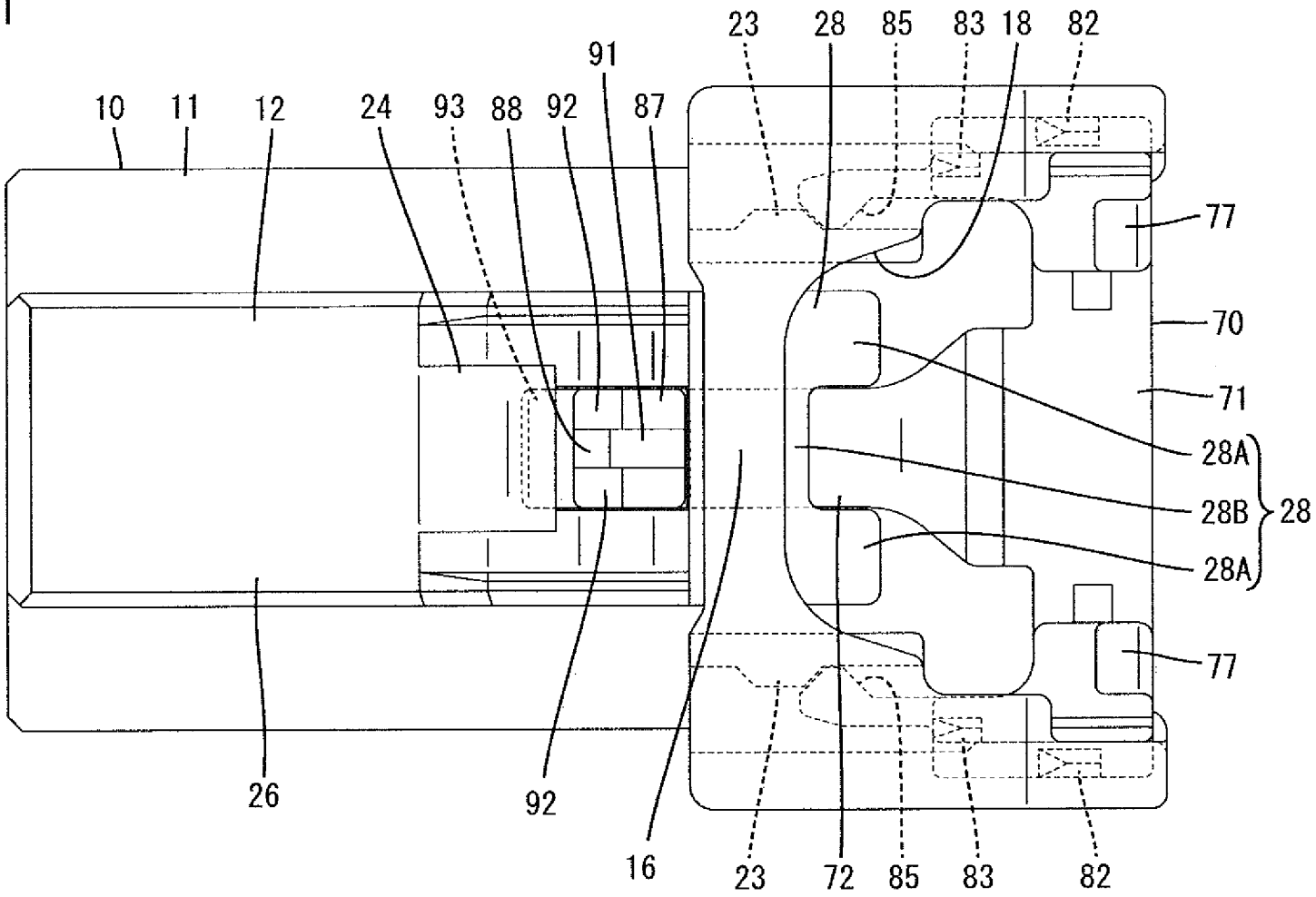
FIG. 1 is a plan view of a housing in which a detecting member is assembled at an initial position in a connector related to embodiment 1 of this invention.

A connector in accordance with some embodiments may provide two pairs of the walls that are aligned in right and left directions, and a bridge portion that overlaps top end portions of the two pairs of walls.

According to this structure, the right and left end portions of the bridge portion are supported at two locations, respectively, where a gap is arranged between the right side and the left side. Thus, the bridge portion can be reliably suppressed or impeded from being bent and deformed such that the center portion is lifted upward.

In the connector of this embodiment, at a rear end portion of the lock arm, a releasing operation portion may be formed, which is pressure-operated downward, if engagement with the lock receiver is released, and the bridge portion may cover only a part of the top surface of the releasing operation portion.

According to this structure, part of the releasing operation portion does not correspond to the bridge portion and is exposed upward. Thus, when the releasing operation portion is released, the bridge portion does not hinder the operation.

Embodiment 1

A first embodiment is disclosed with reference to FIGS. 1-21. The connector related to embodiment 1 is provided with a housing 10 and a counterpart housing 50 that are engageable to each other, and a detecting member 70 that is assembled to the housing 10. Furthermore, with respect to front-and-back directions, in the following explanation, a surface side at which both housings 10 and 50 are engaged to each other is defined as a forward side.

Figure 11:
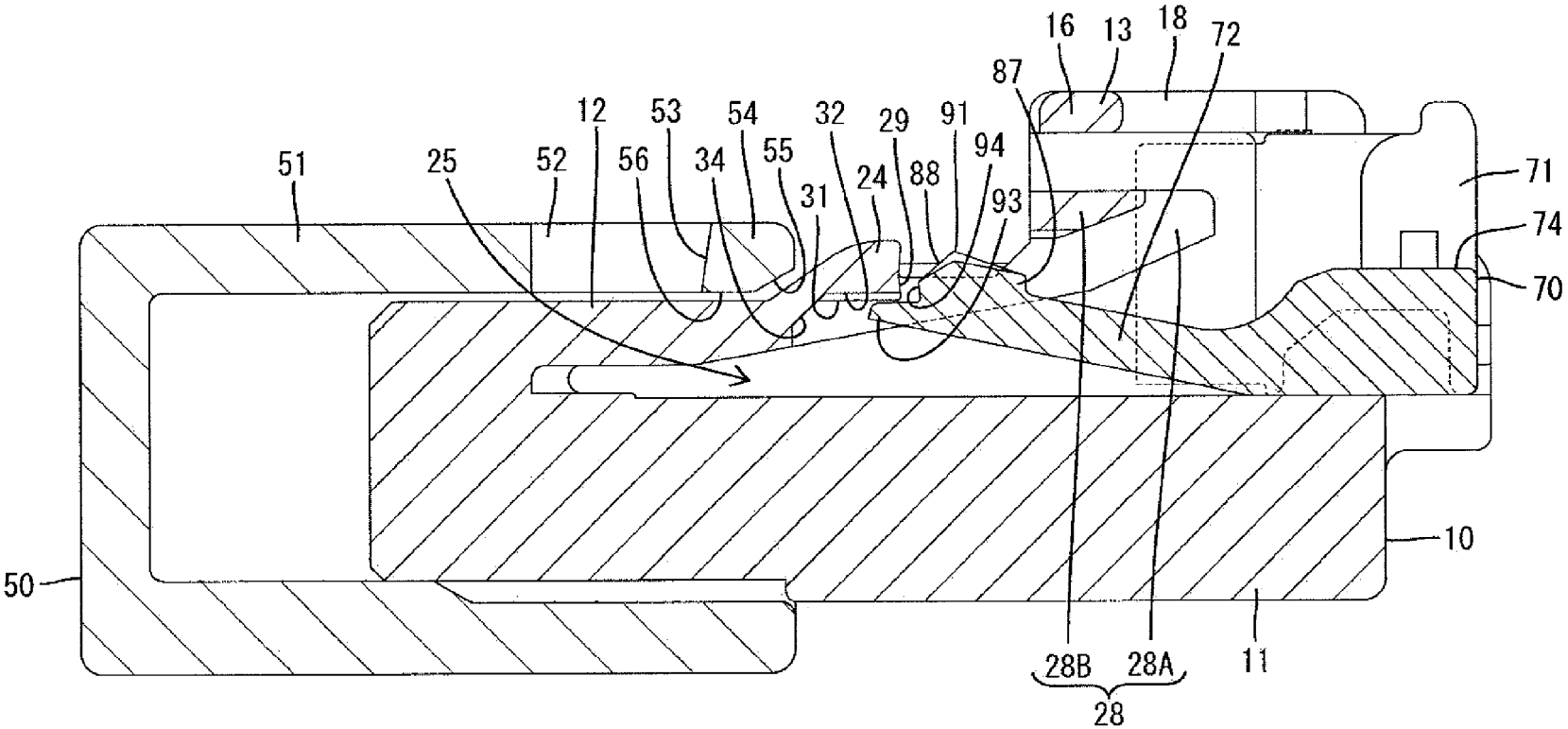
FIG. 11 is a cross-sectional view showing a state in which the detecting member is assembled at an initial position and a housing main body is shallowly engaged to a counterpart housing.

As shown in FIG. 11, the counterpart housing 50 is provided with a hood portion 51 that is a cylindrical shape and opens forward. A lock receiver 52 is formed on a front end portion of the upper wall of the hood portion 51. The lock receiver 52 extends through the upper wall in a height direction (direction crossing a direction in which the housings 10 and 50 are engaged to each other). An inside front surface of the lock receiver 52 is a reverse-tapered engagement receiving surface 53 that is inclined slightly upward in a forward direction.

Additionally, an interfering portion 54 is formed on the front end portion of the upper wall of the hood portion 51, at a position immediately in front of the lock receiver 52. On a front surface lower end portion of the interfering portion 54, a tapered inclined surface 55 is formed that is inclined upward in a forward direction. Additionally, the lower surface of the interfering portion 54 is arranged substantially horizontally from the inclined surface 55 to the lock receiver 52 and is defined as a pressing surface 56, which can press down a protrusion 87 (which will be described later) of a detecting member 70 and a lock protrusion 24 of a lock arm 12.

The housing 10 is a synthetic resin and is constituted by: (i) a block-shaped housing main body 11, and (ii) a bendable cantilevered-shaped lock arm 12 that is integrally connected to the top surface of the housing main body 11. A terminal metal fitting (not shown) can be inserted into the inside of the housing main body 11.

Figure 5:
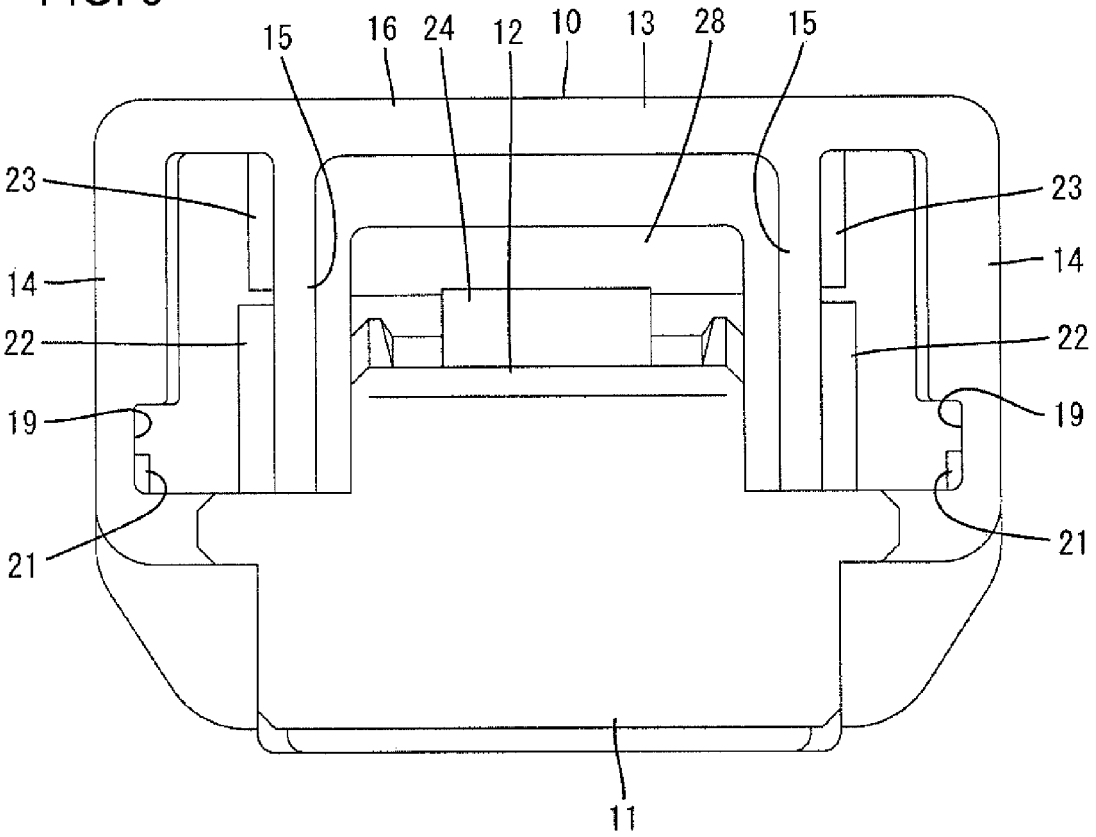
FIG. 5 is a front view of the housing.
Figure 6:
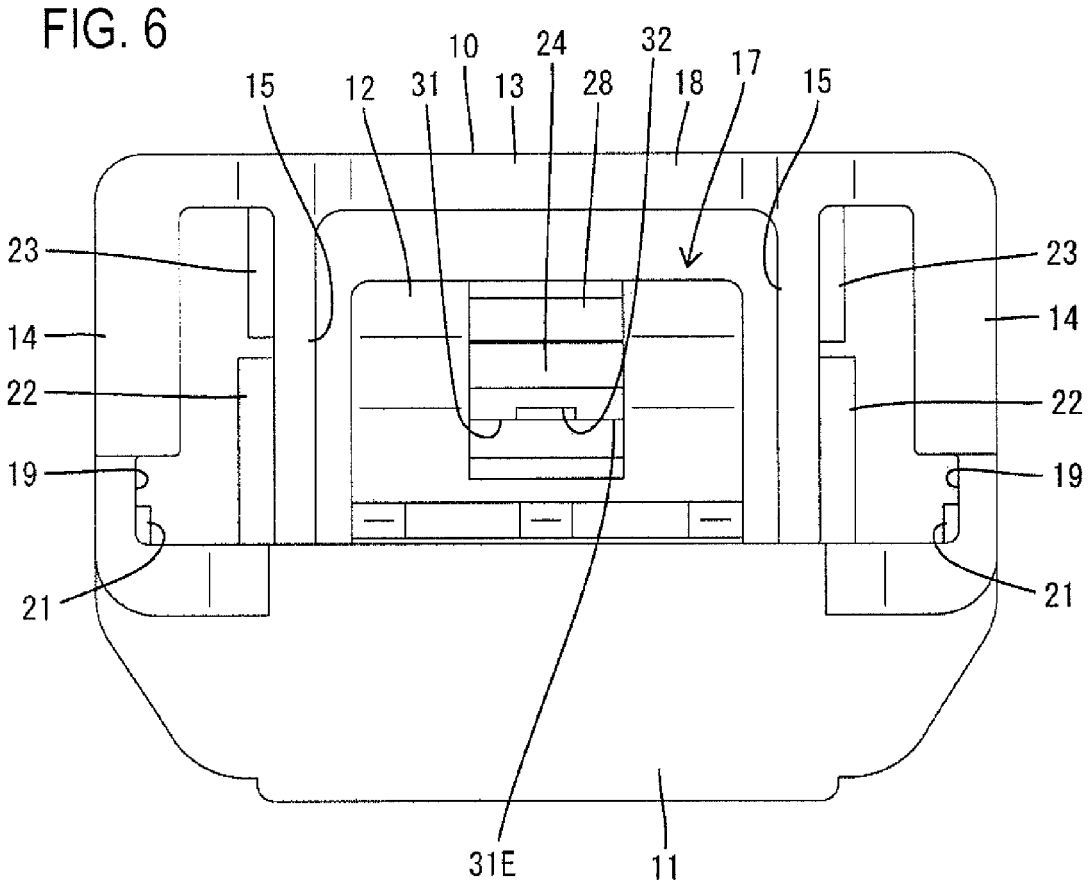
FIG. 6 is a rear view of the housing.

As shown in FIGS. 5 and 6, on the top surface of the rear end portion of the housing main body 11, an arch-shaped excessive bending restriction portion 13 is formed, which surrounds the rear end portion (a releasing operation portion 28 which will be described later) of the lock arm 12. Additionally, as shown in FIG. 19, in the space inside of the excessive bending restriction portion 13, an assembly space 17 is arranged, into which the detecting member 70 is inserted from the rear side.

As shown in FIGS. 5 and 6, the excessive bending restriction portion 13 includes: (i) a pair of outside walls 14 (walls that are structural elements of this embodiment) that are symmetrical to each other and are raised upward from both end portions, in a width direction, of the top surface of the housing main body 11, (ii) a pair of inside walls 15 (walls that are elements of this embodiment) that are symmetrical to each other, are raised upward from the top surface of the housing main body 11, and are positioned inside of the outside walls 14, and (iii) a horizontal plate-shaped bridge portion 16 that is arranged over the entire width of the housing man body 11 that is continuous to each top end of the inside walls 15 and the outside walls 14. Specifically, the left end portion and the right end portion of the bridge portion 16 are supported by two pairs of side walls 14 and 15, respectively, between which gaps are arranged at the right and left sides.

Figure 3:
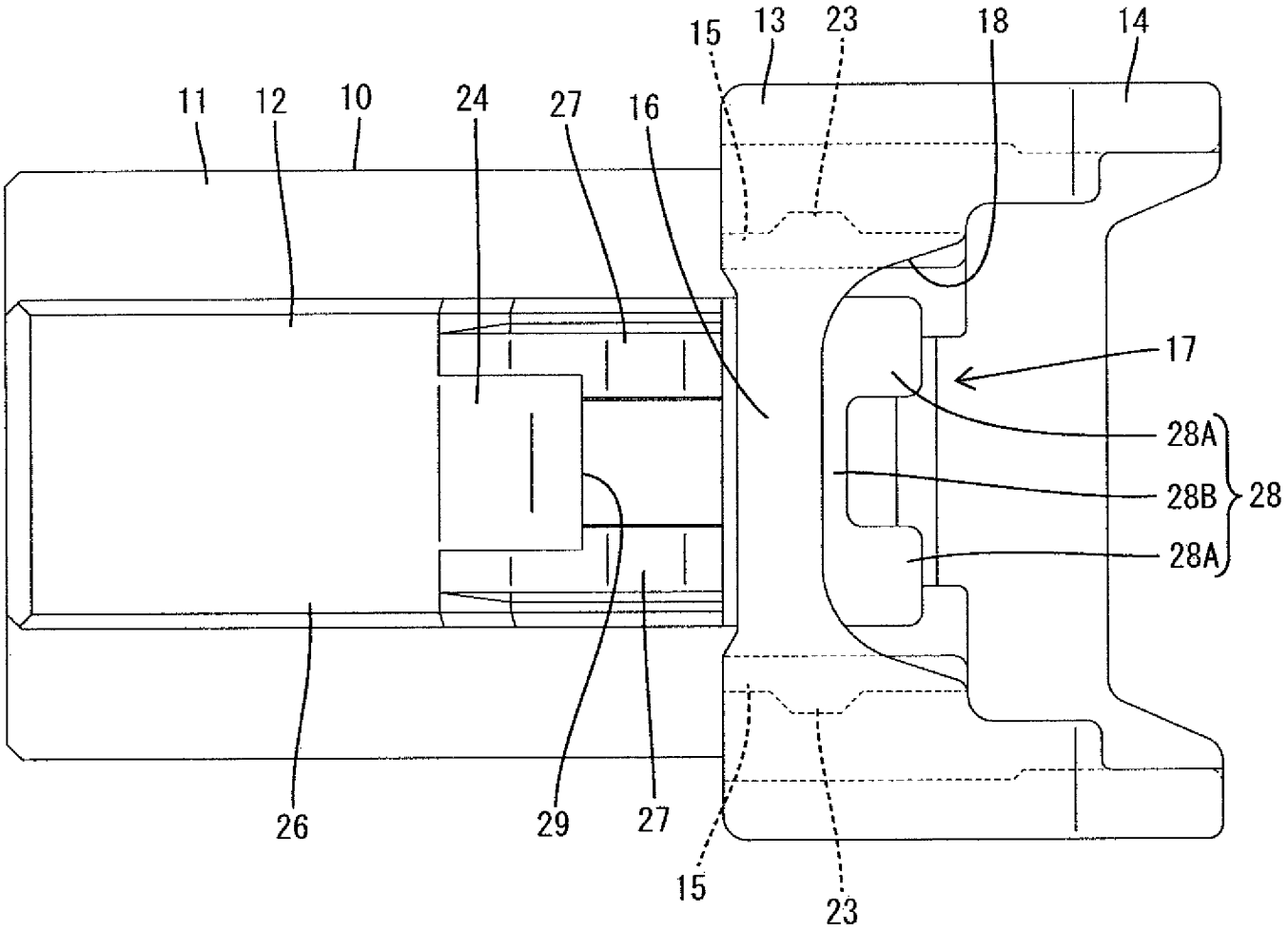
FIG. 3 is a plan view of the housing.

As shown in FIG. 3, in the bridge portion 16, a notch portion 18 is formed whose rear periphery is notched. A rear end side area of the releasing operation portion 28 of the lock arm 12 can be visually recognized from an upper direction through the notched portion 18. Specifically, by forming the notched portion 19, the releasing operation portion 28 can be pressed down (in a direction in which locking is released) for operation. Furthermore, as the rear ends of the inside walls 15 are divided by the notched portion 18, they are positioned forward of the rear ends of the outside walls 14.

Figure 16:
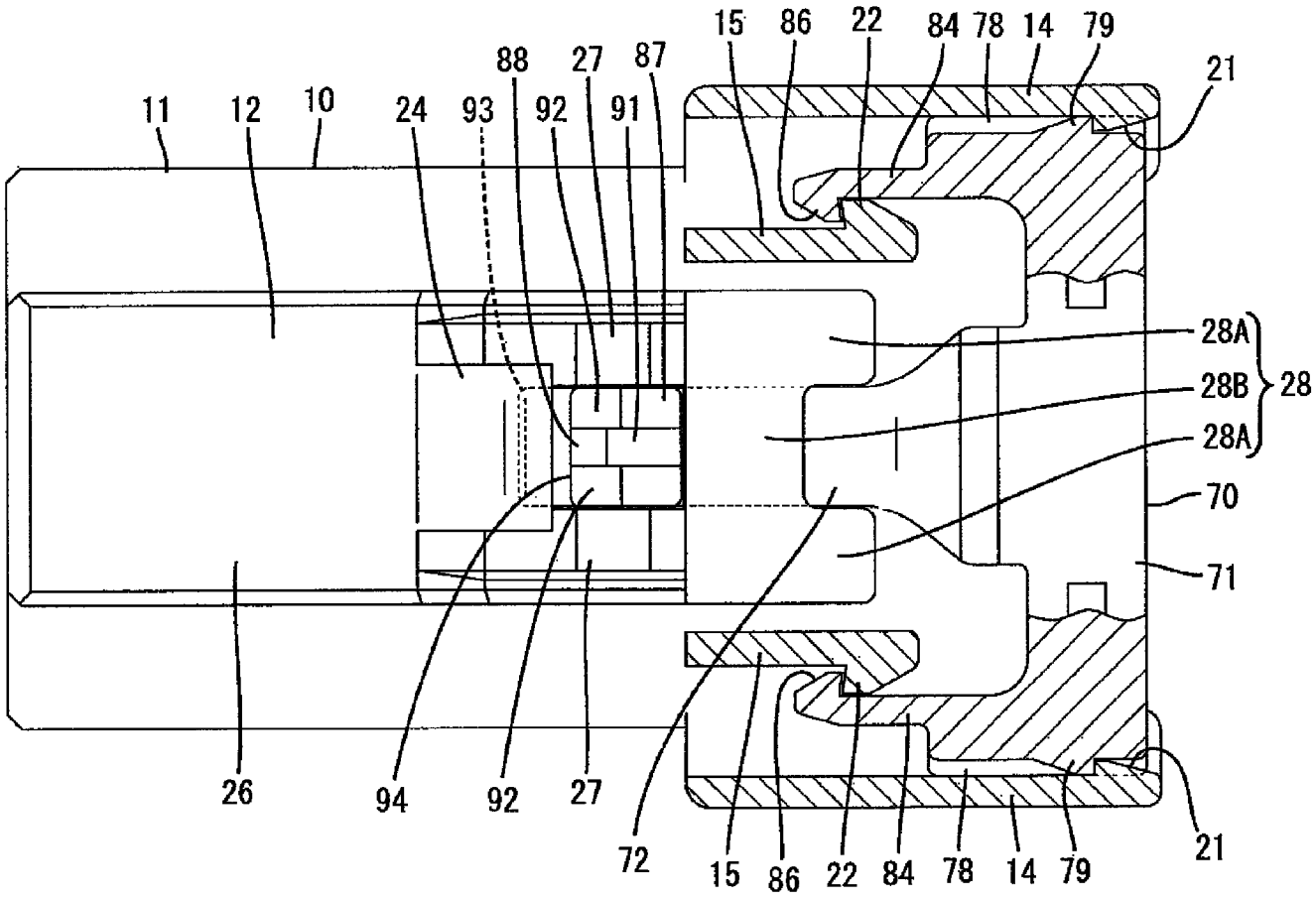
FIG. 16 is a cross-sectional view of a main portion showing a state in which the detecting member is suppressed from slipping off from the housing main body at the initial position.
Figure 19:
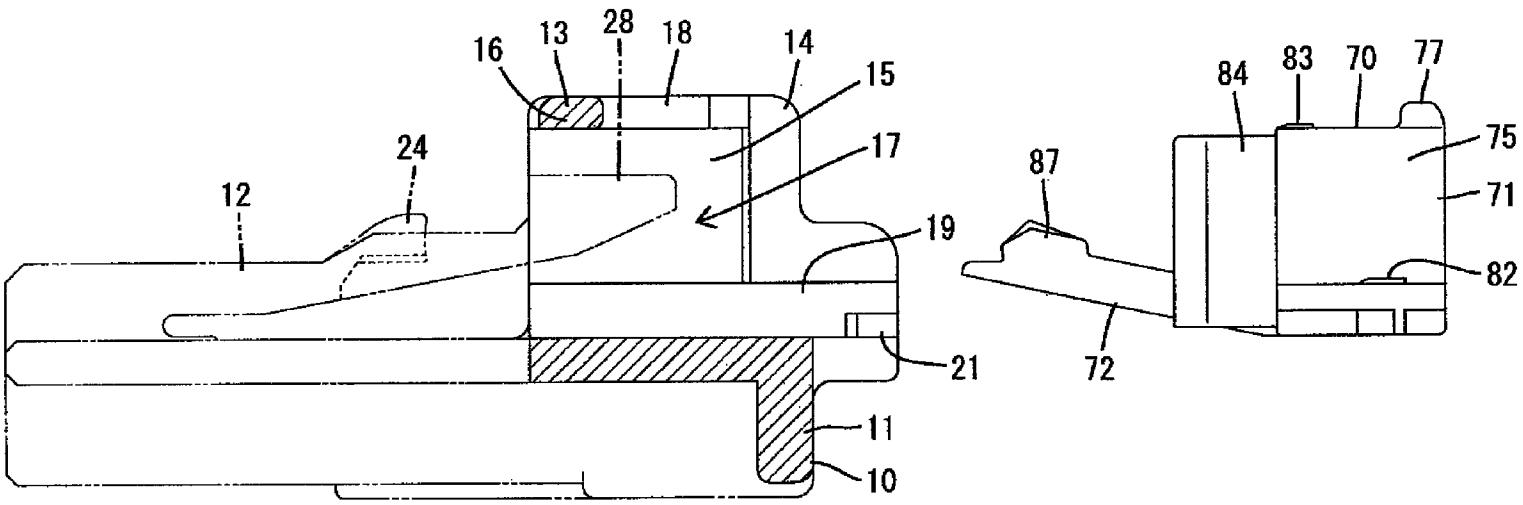
FIG. 19 is a side view of a main portion showing a state before the detecting member is assembled into the housing main body.

As shown in FIGS. 5 and 19, inside of the lower end portions of the outside walls 14, a pair of guide grooves 19 is formed. Both of the guide grooves 19 form concave portions, extend in a front-to-back direction, and are open at the front and back ends of the outside walls 14. Inside of the rear end lower portions of the guide grooves 19, a pair of first retainers 21 is formed protruding inward. As shown in FIG. 16, the rear surfaces of the first retainers 21 are formed in a tapered shape that is inclined inward in a forward direction, and the front surfaces of the first retainers 21 are formed substantially along a width direction.

On the outside surfaces of the rear end portions of the inside walls 15, a pair of second retainers 22 are formed protruding outward. As shown in FIGS. 5 and 6, the second retainers 22 are formed in a rib shape that elongatedly extends upward in a height direction from the top surface of the housing main body 11. Additionally, as shown in FIG. 16, the rear surfaces of the second retainers 22 are formed in a tapered shape that is inclined outward in a forward direction, and the front surfaces of the second retainers 22 are formed in a tapered shape that is inclined slightly inward in a forward direction.

Figure 17:
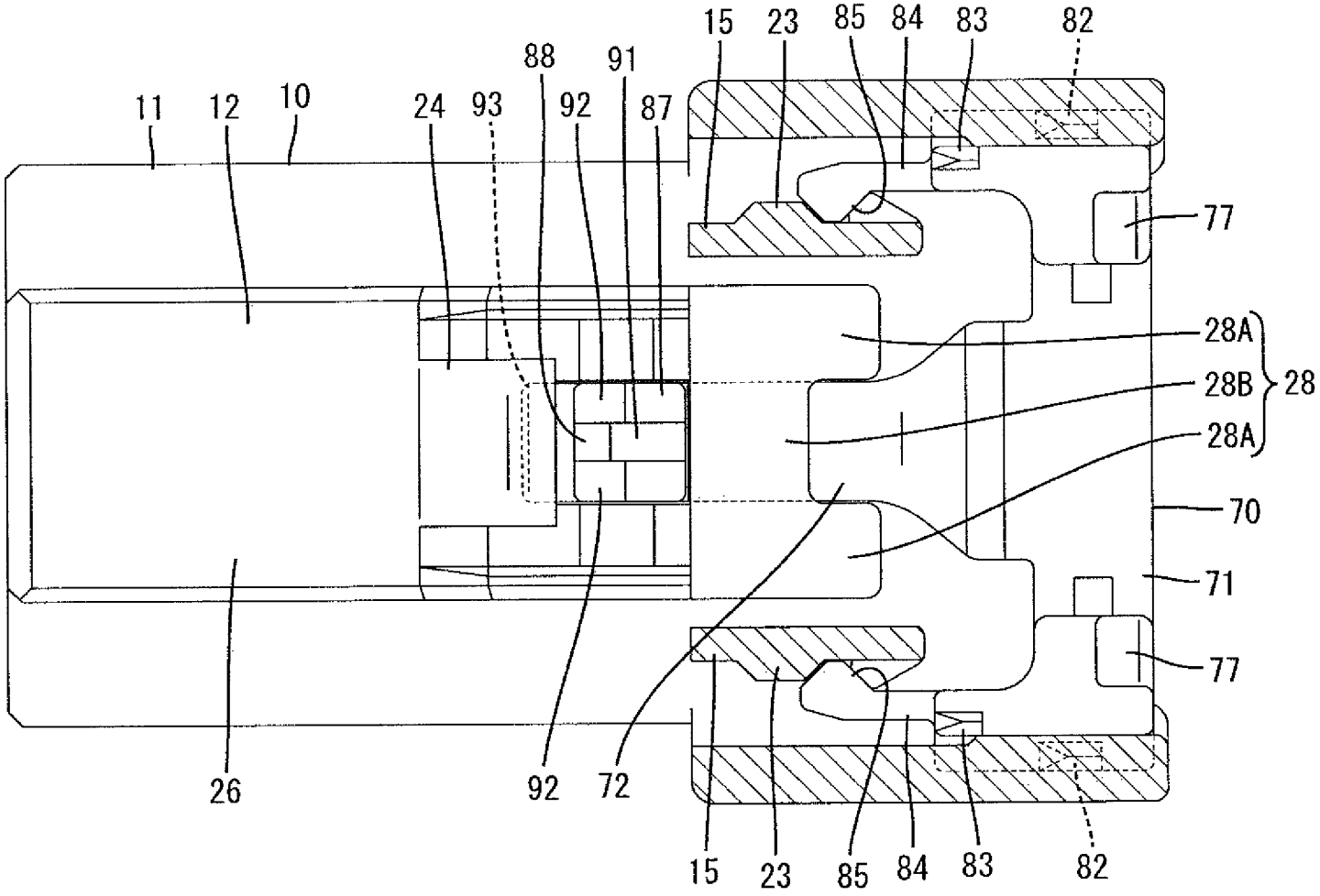
FIG. 17 is a cross-sectional view of a main portion showing a state in which the detecting member is restricted from being moved to the detecting position at the initial position.

Additionally, as shown in FIG. 17, on the outside surfaces of the front end portions of the inside walls 15, a pair of restriction portions 23 are formed protruding outward. As shown in FIGS. 5 and 6, the restriction portions 23 are formed in a rib shape that elongatedly extends downward in a height direction from the lower surface of the bridge portion 16. Additionally, the restriction portions 23 are provided with a smaller protruding dimension than that of the second retainers 22, and a shorter extension length than that of the second retainers 22 and are arranged upward of the second retainers 22. As shown in FIG. 17, the rear surfaces of the restriction portions 23 are formed in a tapered shape that is inclined outward in a forward direction, and the front surfaces of the restriction portions 23 are formed in a tapered shape that is inclined inward in a forward direction.

Figure 4:
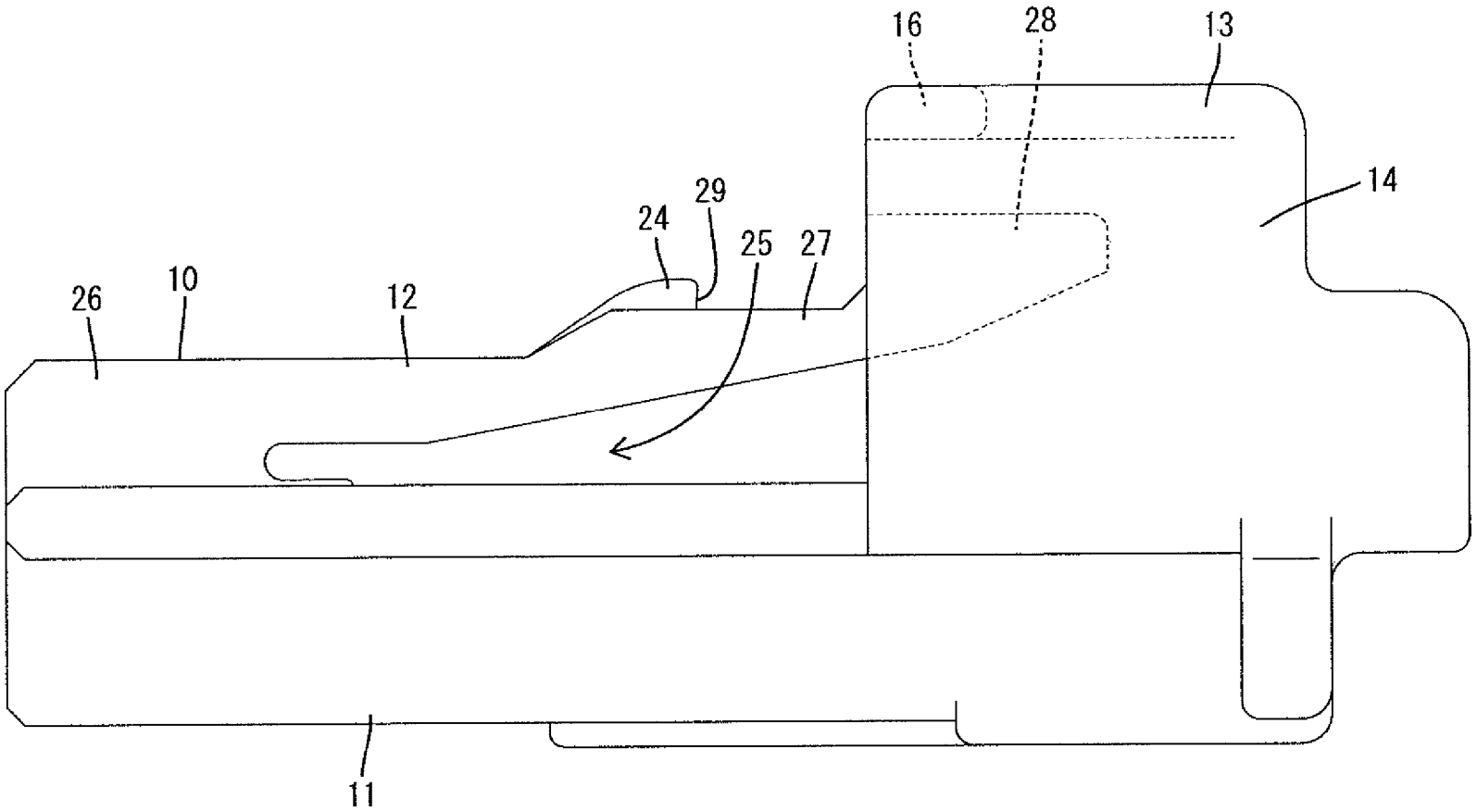
FIG. 4 is a side view of the housing.

As shown in FIG. 4, the lock arm 12 extends rearward in a cantilevered shape from the top surface of the front end portion of the housing main body 11. Between the lower surface of the lock arm 12 and the top surface of the housing main body 11, a bending space 25 is formed, which allows elastic bending of the lock arm 12 in a process in which the housing main body 11 is engaged to the counterpart housing 50.

Furthermore, as shown in FIG. 3, in a substantially center portion of the lock arm 12 in the front-to-back direction, a lock protrusion 24 is formed protruding in a height direction. As shown in FIG. 11, on the rear surface of the lock protrusion 24, an engaging surface 29 is arranged, which is released rearward. An upper portion side facing an engagement receiving surface 53 of the lock receiver 52 is formed in a slightly reverse-tapered shape, and a lower side facing an abutting portion 94 (discussed below) of the detecting member 70 is formed in a slightly tapered shape.

The lock arm 12 is provided with a rectangular-plate shaped base end portion 26 that is forward of the lock protrusion 24. As shown in FIG. 4, the front end side of the base end portion 26 is connected to the top surface of the housing main body 11 and constitutes a fulcrum of a bending operation of the lock arm 12. Additionally, as shown in FIGS. 3 and 4, the lock arm 12 is provided with: (i) a pair of side frames 27 that are symmetrical to each other and extend rearward from both sides of the lock protrusion 24, and (ii) a releasing operation portion 28 that releases the locking of the lock arm 12.

As shown in FIGS. 1 and 11, the releasing operation portion 28 includes: (i) a pair of first operating portions 28A that are symmetrical to each other, and (ii) a second operating portion 28B. As shown in FIGS. 3 and 4, the top surfaces of the rear end portions of the side frames 27 are arranged higher than the top end of the lock protrusion 24. These high areas are the first operating portions 28A. Additionally, the second operating portion 28B forms a plate shape that bridges the top ends of a pair of first operating portions 28A that are symmetrical to each other.

In the front-to-back direction, front end peripheries of the releasing operating portions 28 are arranged at the same position as the front end periphery of the bridge portion 16. Both rear end peripheries of the first operating portions 28A and the rear end periphery of the second operating portion 28B are positioned rearward of the rear end periphery of the bridge portion 16. Thus, the front end side area of the releasing operation portion 28 is over the entire width of the right-to-left direction and is covered by the bridge portion 16 from an upper direction. Additionally, the rear end side area of the releasing operation portion 28 corresponds to the notch portion 18, so it is released upward. Furthermore, the rear ends of the first operation portion 28A protrude rearward of the rear end of the second operating portion 28B. Thus, the exposed area of the notch portion 18 in the front-to-back direction of the first operating portions 28A is larger than that of the second operating portion 28B.

Figure 13:
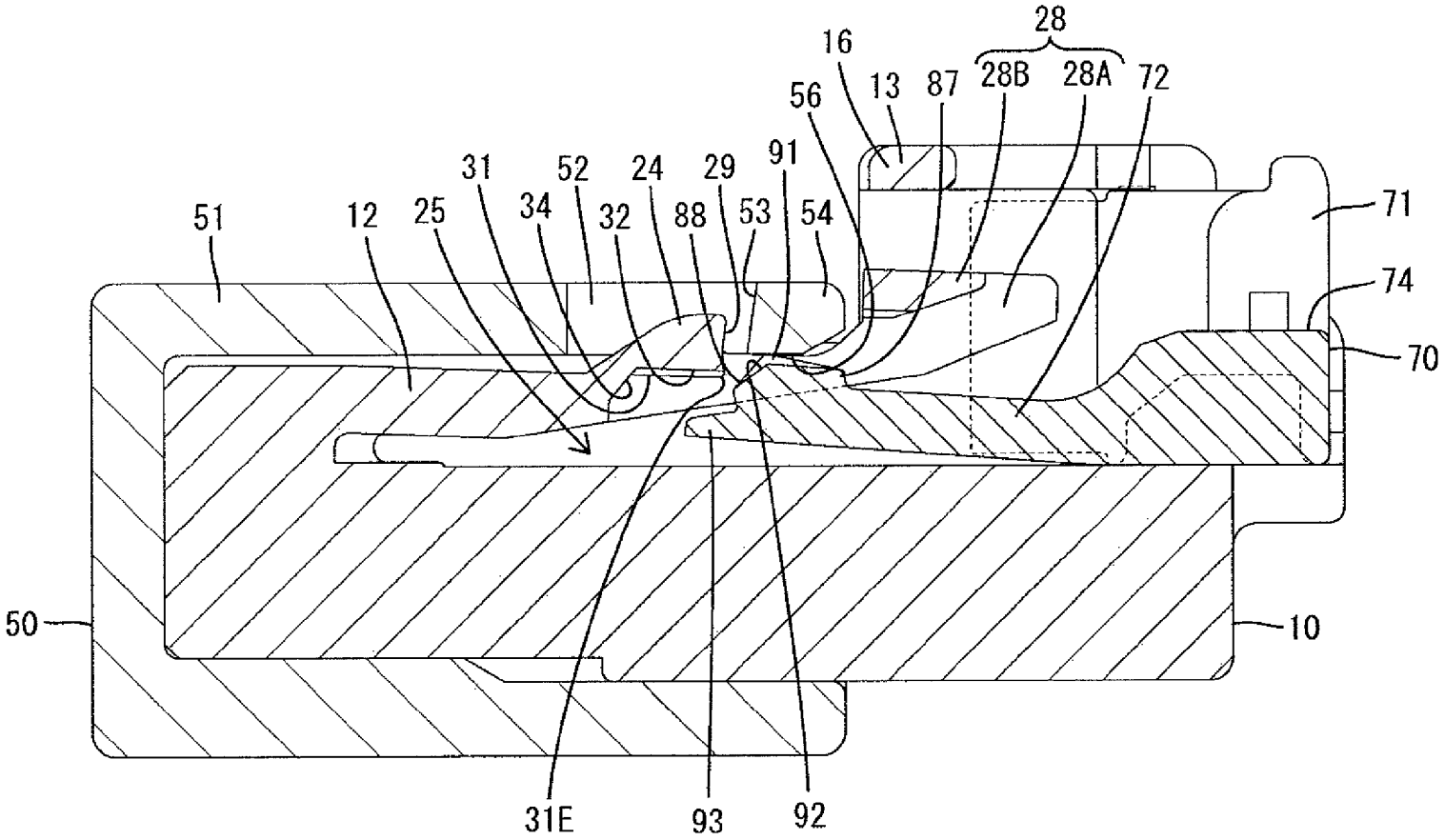
FIG. 13 is a cross-sectional view showing a state in which the housing main body is engaged to the counterpart housing, the lock arm is engaged to a lock receiver, and the detecting member is kept at a waiting position.

As shown in FIG. 13, when the housings 10 and 50 are engaged to each other, the lock protrusion 24 is elastically engaged to the lock receiver 52 from a downward direction, the engaging surface 29 is arranged so as to be able to contact the engagement receiving surface 53, and the housings 10 and 50 are held so as to be engaged to each other. Meanwhile, while the housings 10 and 50 are engaged to each other, as the top surfaces of the releasing operation portion 28 are pressed down, the lock arm 12 is bent and deformed in the bending space 25. Thus, the lock protrusion 24 comes out from the lock receiver 52, and the housings 10 and 50 can be separated.

Additionally, as shown in FIG. 11, on the lower surface of the lock arm 12, an accommodating concave portion 31 is formed opening rearward. In the front-to-back direction, the accommodating concave portion 31 is positioned so as to correspond to the lock protrusion 24. The accommodating concave portion 31 is formed in appropriate size and shape so that the protrusion 87 of the detecting member 70 is be able to be fitted therein, and the lower surface of the lock arm 12 (the bending space 25 side) and the rear surface of the lock protrusion 24 open rearward. The inside top surface of the housing concave portion 31 is positioned upward of the top surface of the base end portion 26 of the lock arm 12. Additionally, on the inside top surface of the housing concave portion 31, an auxiliary concave portion 32 is formed to be partially concave. As shown in FIG. 6, the auxiliary concave portion 32 is arranged at the center portion, in the width direction, on the inside top surface of the housing concave portion 31, and its width dimension is substantially ⅓ the entire width of the housing concave portion 31. Furthermore, a depth of the auxiliary concave portion 32 is sufficiently smaller than that of the housing concave portion 31.

Figure 7:
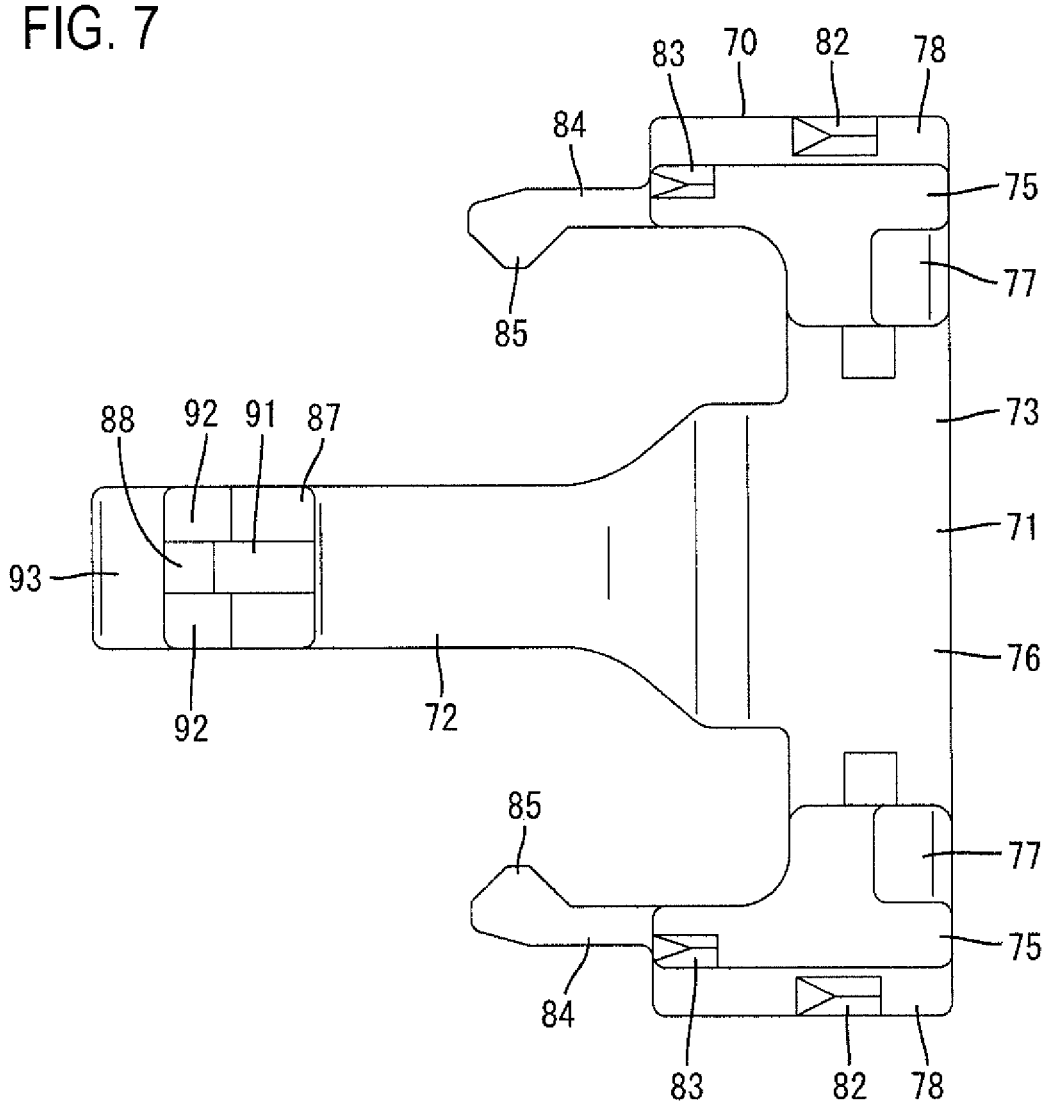
FIG. 7 is a plan view of the detecting member.
Figure 8:
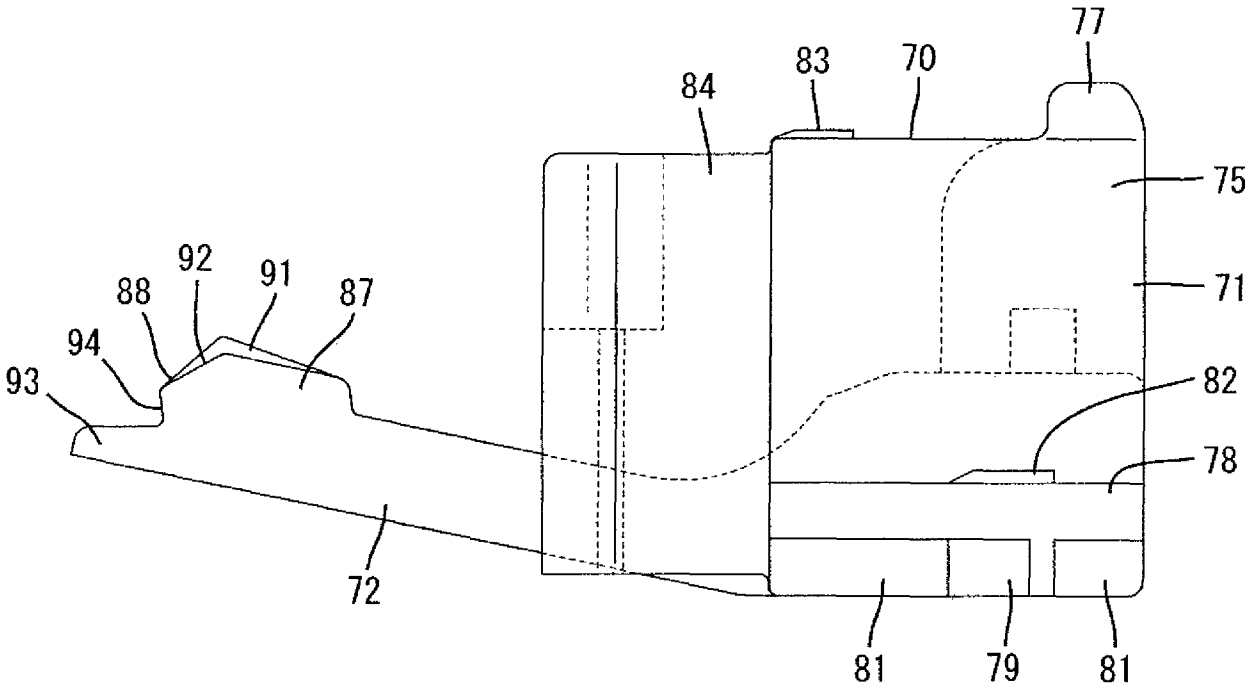
FIG. 8 is a side view of the detecting member.

The detecting member 70 is explained below. In the same manner as the housing main body 11, the detecting member 70 is a synthetic resin. As shown in FIGS. 7 and 8, the detecting member 70 is provided with: (i) a main body portion 71, and (ii) an elastic arm portion 72 that is integrally connected to a front end of the main body portion 71 or formed unitarily therewith. Additionally, the detecting member 70 is assembled so as to be movable with respect to the housing main body 11 to a detecting position via a waiting position from an initial position.

Figure 2:
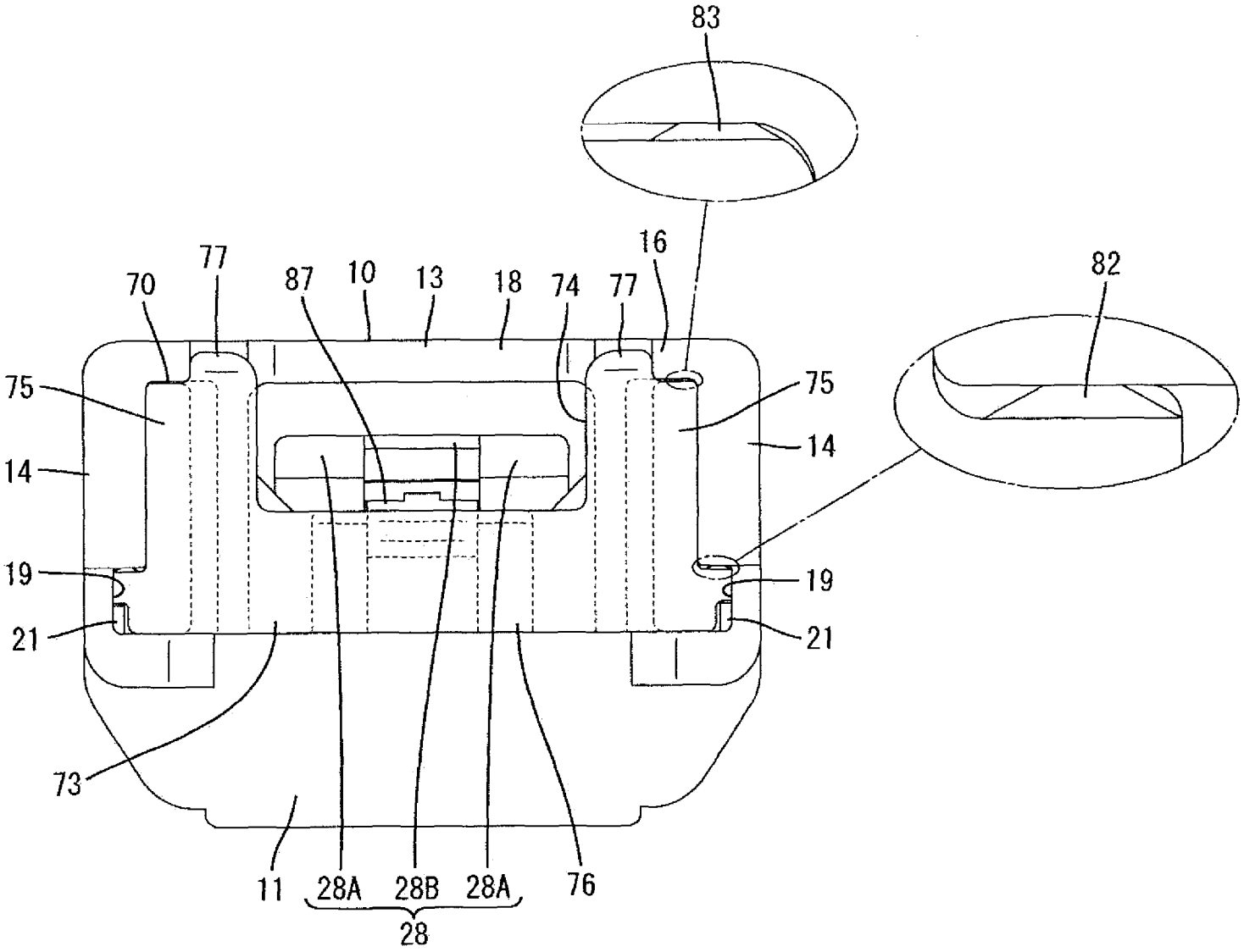
FIG. 2 is a rear view of the housing in which the detecting member is assembled at an initial position.
Figure 9:
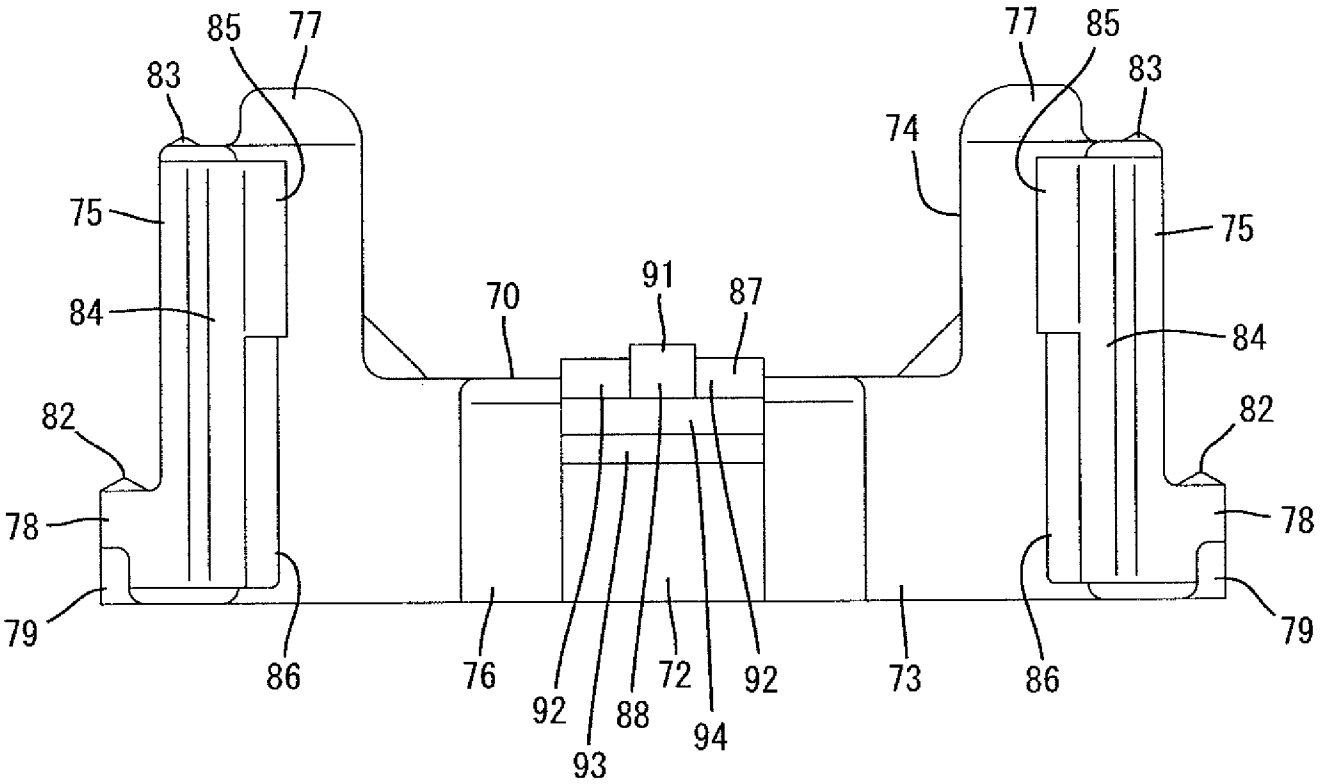
FIG. 9 is a front view of the detecting member.

As shown in FIGS. 2 and 9, the main body portion 71 is provided with a rear portion 73 that extends in a width direction and a height direction. The rear portion 73 is formed such that a releasing operation window 74 is open. The releasing operation window 74 is formed so as to be significantly concave in a substantially U shape at the substantially center portion, in the width direction, of the top end periphery of the rear portion 73. In rear view, when the detecting member 70 is assembled in the housing main body 11, the releasing operation portion 28 of the lock arm 12 can be visually recognized via the releasing operation window 74.

Additionally, the rear portion 73 is provided with: (i) a pair of vertical portions 75 that extend in a height direction at both end portions of, in the width direction, of the rear portion, and (ii) a width portion 76 that extends, in a width direction, continuous to the lower end portions of the both vertical portions 75. The releasing operation window 74 is divided by the vertical portions 75 and the width portion 76. The respective rear surfaces of the vertical portions 75 and the width portion 76 are arranged substantially along a height direction and can be pressed from a rear direction when they move to the detecting position. Additionally, on the top ends of the both vertical portions 75, a pair of hook portions 77 is formed so as to protrude therefrom. A finger or a jig is hooked to the hook portions 77, and in that state, a pulling force in a rearward direction acts on the hook portions 77 such that the detecting member 70 is pulled back from a detecting position to an initial position.

Figure 10:
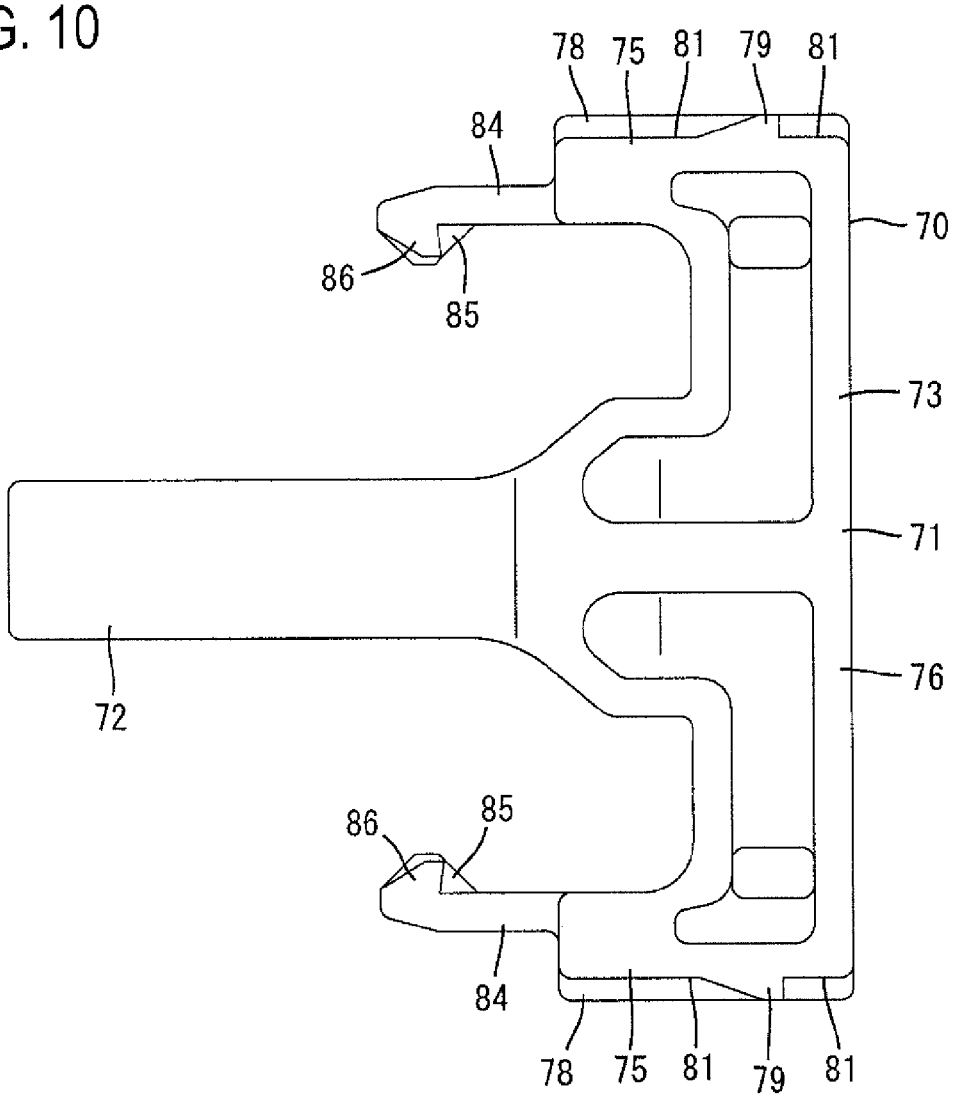
FIG. 10 is a bottom view of the detecting member.

As shown in FIG. 8, the vertical portions 75 are formed in a substantially rectangular shape in side view. A pair of guide portions 78 is provided at the lower end portions of the outside surfaces of the vertical portions. The guide portions 78 are formed in a rib shape that extends the entire length of the width portions 76 in the front-to-back direction. A pair of first stoppers 79 is formed on substantially the lower half portions of the guide portions 78, as shown in FIG. 10. Rear surfaces of the first stoppers 79 are along a width direction. Additionally, at both front and back sides sandwiching the first stoppers 79, the guide portions 78 are provided with groove portions 81 whose both front and back ends open in the forward and rearward directions.

As shown in FIGS. 8 and 9, on the top surfaces of the rear portions of the guide portions 78, a pair of first rattle restriction portions 82 are formed so as to protrude at a position that overlaps the first stoppers 79 in a front-to-back direction. The first rattle restriction portions 82 are formed in a cross-sectionally triangular rib shape that extends in the front-to-back direction and are arranged lower than and rearward of both end portions, in a width direction, of the main body portion 71.

Additionally, on the top end surfaces of the front portions of the vertical portions 75, a pair of second rattle restriction portions 83 is formed so as to protrude therefrom. The second rattle restriction portions 83 form cross-sectionally triangular rib shapes that extend in the front-to-back direction and are a size smaller than the first rattle restriction portions 82. Furthermore, the second rattle restriction portions 83 are arranged higher than and forward of both end portions, in the width direction, of the main body portion 71. In a process in which the detecting member 70 moves, the first rattle restriction portions 82 slidably contact the inside top surfaces of the guide grooves 19 in a pressed state, and the second rattle restriction portions 83 slidably contact the lower surface of the bridge portion 16 in a pressed state. Thus, a moving posture of the detecting member 70 can be corrected to be a normal posture.

As shown in FIG. 7, on the front ends of the vertical portions 75, a pair of elastic pieces 84 are formed so as to protrude forward. As shown in FIG. 8, the elastic pieces 84 form a substantially rectangular plate shape in side view, and can be bent and deformed in a width direction by using the front ends of the vertical portions 75 as a fulcrum. Additionally, as shown in FIG. 9, on the front end portions of the elastic pieces 84, a pair of temporary engaging portions 85 and a pair of second stoppers 86 are aligned and formed in a height direction.

Figure 18:
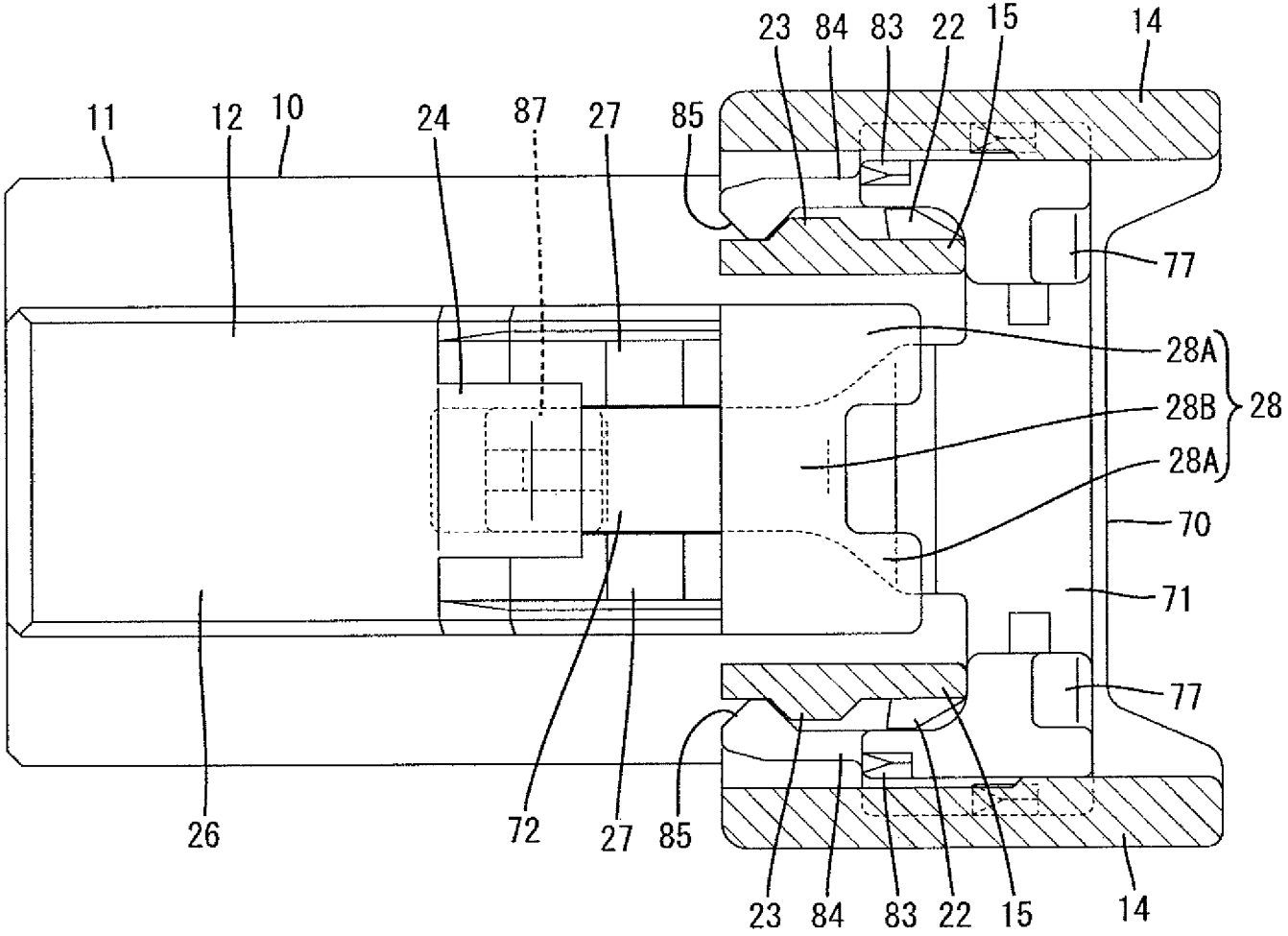
FIG. 18 is a cross-sectional view of a main portion showing a state in which the detecting member is restricted from being returned to the initial position at the waiting position.

The temporary engaging portions 85 extend in a height direction and protrude inward from substantially upper half portions of the front end portions of the elastic pieces 84. As shown in FIG. 7, the rear surfaces of the temporary engaging portions 85 are formed in a tapered shape that is inclined inward in a forward direction, and the front surfaces of the temporary engaging portions 85 are formed in a tapered shape that is inclined outward in a forward direction. As shown in FIG. 17, when the detecting member 70 is at an initial position, as the front surfaces of the temporary engaging portions 85 contact the restriction portions 23 from behind in a half-lock state, movement of the detecting member 70 to a detecting position is secondarily restricted. Additionally, as shown in FIG. 18, when the detecting member 70 is at a detecting position, as the rear surfaces of the temporary engaging portions 85 contact the restriction portions 23 from in front in a half-lock state, the returning movement of the detecting member 70 to an initial position is secondarily restricted.

As shown in FIG. 9, the second stoppers 86 protrude from substantially lower-half portions of the front end portions of the elastic pieces 84 and extend in a height direction. As shown in FIG. 10, the second stoppers 86 are formed a size smaller than the temporary engaging portions 85. Additionally, the rear surfaces of the second stoppers 86 are formed in a reverse-tapered shape that is inclined slightly inward in the rearward direction. As shown in FIG. 16, when the detecting member 70 is at an initial position, the rear surfaces of the first stoppers 79 contact the first retainers 21 from in front, and the rear surfaces of the second stoppers 86 contact the second retainers 22 from in front. Thus, the detecting member 70 is restricted from slipping out from the housing main body 11.

As shown in FIG. 8, the elastic arm portion 72 extends slightly forward in a cantilever shape from the substantially center portion, in the width direction, of the front end of the main body portion 71. Furthermore, the elastic arm portion 72 forms a substantially square bar shape, and can be bent and deformed in a height direction (the same vertical direction as the lock arm 12) by using the rear end portion, which is continuous to the front end of the main body portion, 71 as a fulcrum. In a natural state, the elastic arm portion 72 is inclined upward at a substantially predetermined angle of inclination from the rear end to the front end.

Figure 12:
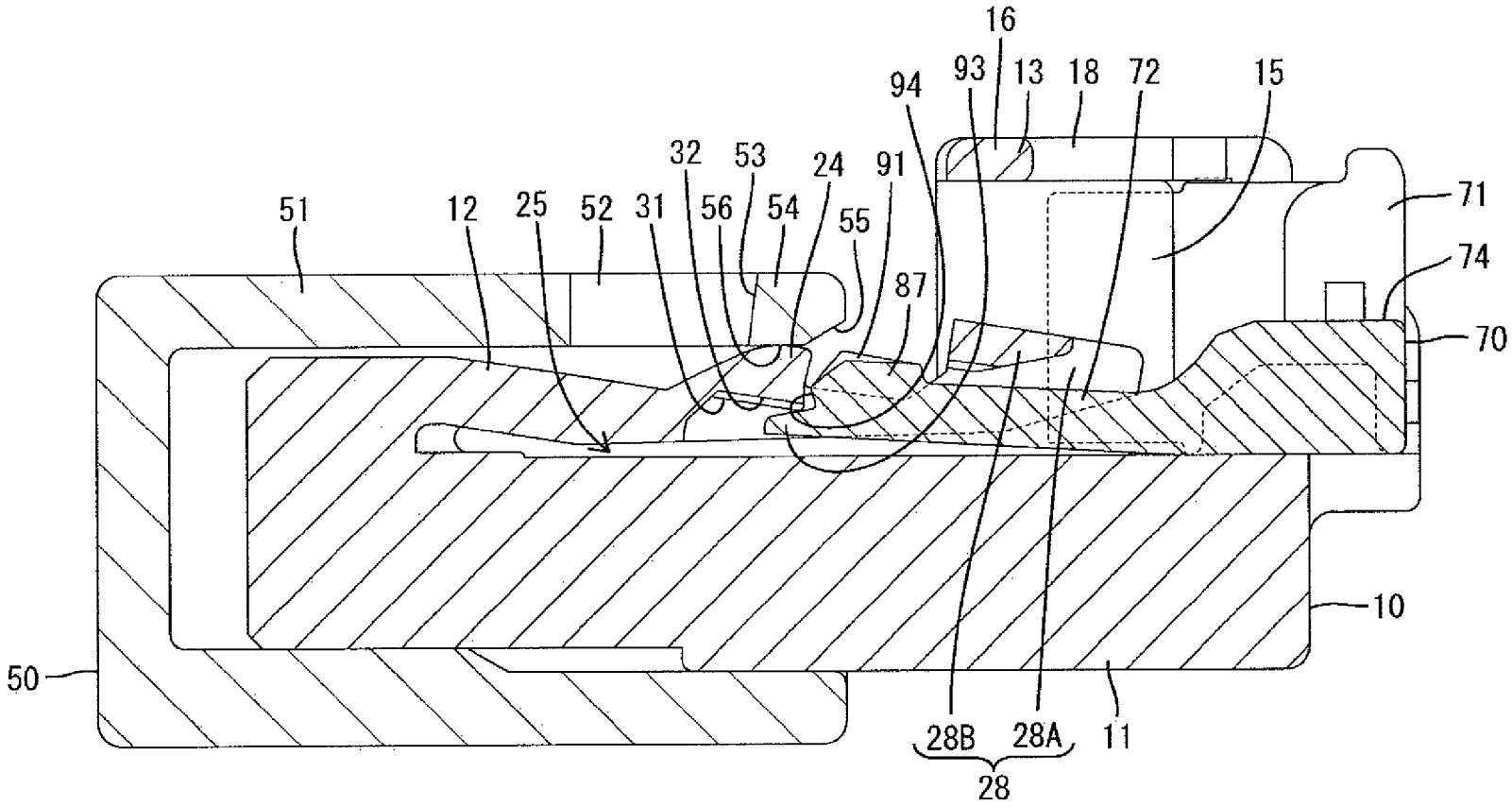
FIG. 12 is a cross-sectional view showing a state in which engagement is further performed, a lock protrusion is pressed against a pressing surface of an interfering portion, and a lock arm is largely bent and deformed.
Figure 15:
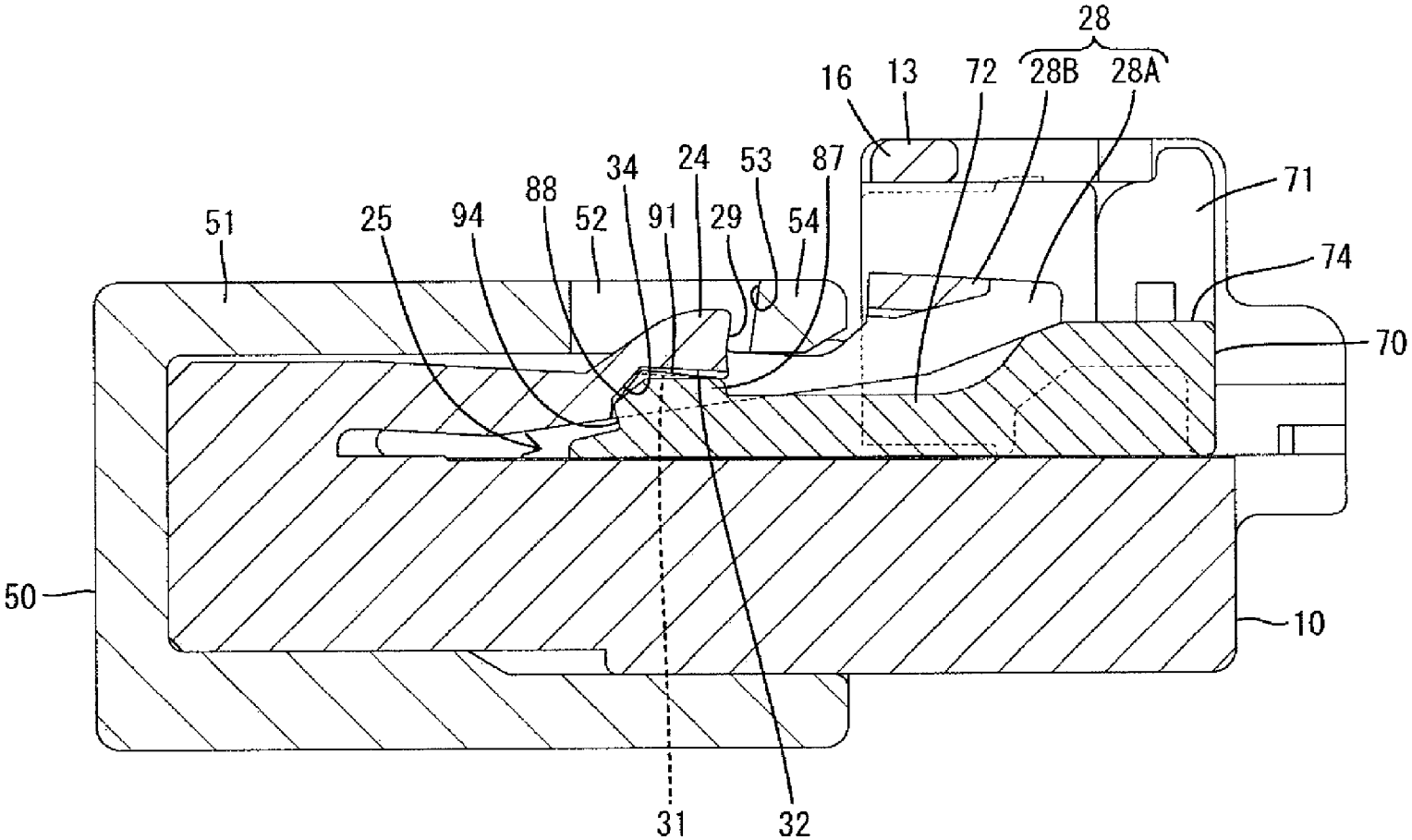
FIG. 15 is a cross-sectional view showing a state in which the detecting member reaches the detecting position and the protrusion is housed in the housing concave portion.

Meanwhile, as shown in FIGS. 11-13, as the detecting member 70 is displaced from an initial position to a waiting position, the elastic arm portion 72 is bent and deformed so as to gradually decrease the angle of inclination. Furthermore, as shown in FIG. 15, when the detecting member 70 reaches the detecting position, the elastic arm portion 72 forms a substantially vertical posture without being substantially inclined. Because of this, the elastic arm portion 72 stores an elastic force at the waiting and detecting positions.

As shown in FIG. 8, on the front end portion of the elastic arm portion 72 that constitutes the detecting member 70, the substantially square-block-shaped protrusion 87 is formed so as to protrude upward. On the top end surface of the protrusion 87, an auxiliary protrusion 91 is formed so as to partially protrude upward. The auxiliary protrusion 91 is formed in a rib shape that extends in the front-to-back direction at substantially the center portion, in the width direction, of the top end surface of the protrusion 87. Thus, the width of the auxiliary protrusion 91 is narrower than that of the protrusion 87.

A dimension of protrusion, from the protrusion 87 of the auxiliary protrusion 91 in a height direction, is set to be sufficiently smaller than a dimension of protrusion, from the elastic arm portion 72 of the protrusion 87 in the height direction. Additionally, the top surface of the auxiliary protrusion 91 is formed to have a tapered shape that is inclined downward in a rearward direction. Furthermore, when the protrusion 87 is inserted into the accommodating concave portion 31, the auxiliary protrusion 91 is inserted so as to be engaged to the inside of the auxiliary concave portion 32.

On the front surface of the protrusion 87, the center region in the width direction, corresponding to the auxiliary protrusion 91, is inclined in the front-to-back direction (the direction in which the detecting member 70 moves between the waiting position and the detecting position), which makes a steeply inclined surface 88 continuous to the front surface of the auxiliary protrusion 91. Additionally, the auxiliary protrusion 91 and a non-corresponding area (area other than the steeply inclined surface 88), in the width direction, of the front surface of the protrusion 87 form a pair of moderately inclined surfaces 92 that are symmetrical to each other and whose angle of inclination in the front-to-back direction are set smaller than that of the steeply inclined surface 88. Specifically, the front surface of the protrusion 87 includes: (i) the steeply inclined surface 88, and (ii) the pair of moderately inclined surfaces 92 that are positioned so as to sandwich the steeply inclined surface 88 from the right and left sides. Additionally, the pair of moderately inclined surfaces 92 is formed so as to move back to the steeply inclined surface 88 in a stepped shape (that is, laid down rearward of the steeply inclined surface 88).

Figure 14:
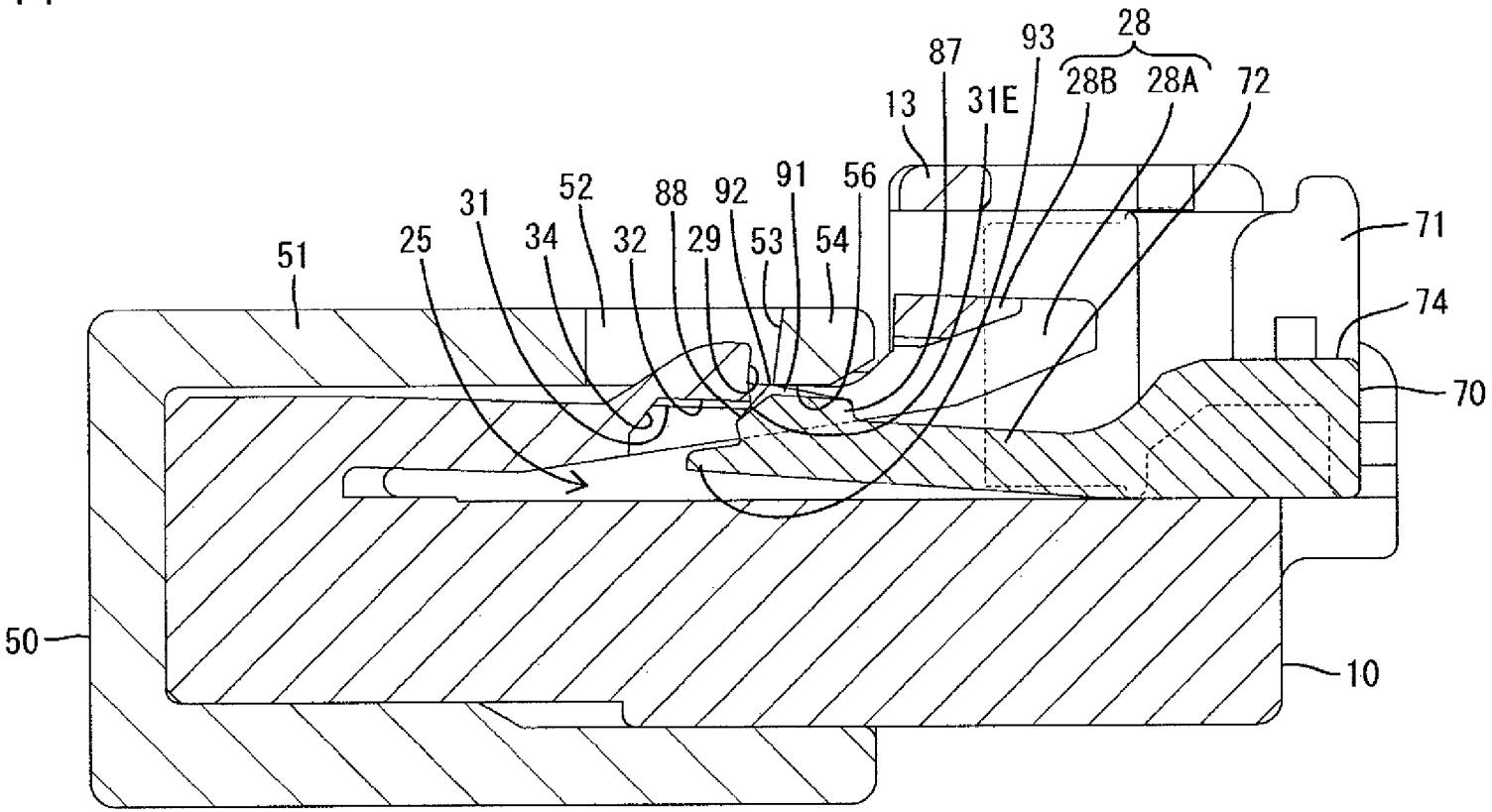
FIG. 14 is a cross-sectional view showing a state in which a guide surface of the lock protrusion slidably contacts a top end opening periphery of a housing concave portion in a process in which the detecting member is moving to a detecting position.

As shown in FIG. 13, when the detecting member 70 is at a waiting position, the moderately inclined surfaces 92 of the protrusion 87 are arranged so as to face a top end opening periphery 31 E of the accommodating concave portion 31 at the rear surface of the lock protrusion 24 from behind. Furthermore, as shown in FIG. 14, in a process in which the detecting member 70 moves from the waiting position to the detecting position, the moderately inclined surfaces 92 slidably contact the top end opening periphery 31E of the accommodating concave portion 31 and accordingly the elastic arm portion 72 is elastically inclined downward. Furthermore, when the detecting member 70 reaches the detecting position, the protrusion 87 is inserted into the accommodating concave portion 31 at a positioning state. Inside of the accommodating concave portion 31, at the detecting position, a tapered guide receiving surface 34 is formed, which faces the steeply inclined surface 88 of the protrusion 87.

Additionally, at the front end lower end portion of the protrusion 87, a contact portion 93 is formed so as to protrude forward. As shown in FIG. 7, the contact portion 93 has a rectangular shape in plan view. As shown in FIG. 11, when the detecting member 70 is at an initial position, the top surface of the contact portion 93 is arranged so as to be substantially horizontal and contacts an inside top surface of the accommodating concave portion 31 from below. By so doing, the elastic arm portion 72 is slightly bent and deformed while a pre-load is applied to the lock arm 12.

Furthermore, as shown in FIG. 8, an area between: (i) the steeply inclined surface 88 and the moderately inclined surfaces 92 on the front surface of the protrusion 87, and (ii) the contact portion 93 is the abutting portion 94. The abutting portion 94 is arranged substantially along a height direction when the elastic arm portion 72 is in a natural state. Additionally, as shown in FIG. 11, when the detecting member 70 is at an initial position, the abutting portion 94 of the protrusion 87 is arranged opposite to the engaging surface 29 of the lock protrusion from behind.

The following explains an operation of the connector related to embodiment 1. When assembly is performed, first, the detecting member 70 is inserted into an assembly space 17 of the housing main body 11 from behind. In an assembly process, the first rattle restriction portions 82 slidably contact the inside top surfaces of the guide grooves 19 in a pressed state, and the second rattle restriction portions 83 slidably contact the lower surface of the bridge portion 16 in a pressed state. Thus, stability of a posture of assembling the detecting member 70 is secured.

Additionally, as shown in FIG. 16, in the assembly process, the elastic pieces 84 are bent and deformed, and as the detecting member 70 reaches an initial position, the elastic pieces 84 elastically return, and the second stoppers 86 are arranged so as to be engageable to the second retainers 22 from in front. At the same time, the first stoppers 79 are arranged so as to be engageable to the first retainers 21 from in front. By so doing, the detecting member 70 is restricted so as not to slip out rearward from the housing main body 11.

As shown in FIG. 11, when the detecting member 70 reaches the initial position, the abutting portion 94 of the protrusion 87 is arranged so as to be engageable to the engaging surface 29 of the lock protrusion 24 from behind. Because of this, if the detecting member 70 is inserted forward at the initial position, the abutting portion 94 contacts the engaging surface 29, and the detecting member 70 is restricted from moving further forward. Additionally, as shown in FIG. 17, as the temporary engaging portions 85 contact the restriction portions 23 from behind, moving forward of the detecting member 70 at the initial position is two-dimensionally restricted. Thus, as shown in FIG. 1, the detecting member 70 is held in the initial position so as to restrict movement relative to the housing main body 11 in the front-to-back direction.

Additionally, as shown in FIG. 11, at the initial position, the contact portion 93 of the elastic arm portion 72 contacts the inside top surface of the accommodating concave portion 31 from below, and the elastic arm portion 72 is held so as to store an elastic force with respect to the lock arm 12. Furthermore, as the contact portion 93 contacts the inside top surface of the accommodating concave portion 31, the amount of overlap of the abutting portion 94 of the protrusion 87 and the engaging surface 29 of the lock protrusion 24 is also automatically determined at a predetermined value. Additionally, as the contact portion 93 contacts the inside top surface of the accommodating concave portion 31 from below, the elastic arm portion 72 is displaced relatively upward with respect to the lock arm 12, that is, contact of the abutting portion 94 and the engaging surface 29 can be suppressed from being released. Thus, moving forward of the detecting member 70 can be more reliably restricted.

Subsequently, the housing main body 11 is engaged to the inside of the hood portion 51 of the counterpart housing 50. In the engaging process, as shown in FIG. 12, after the lock protrusion 24 slidably contacts the inclined surface 55 of the interfering portion 54, it is pressed against the pressing surface 56 of the interfering portion 54, and the lock arm 12 is bent and deformed in the bending space 25. Additionally, when the housing main body 11 is engaged to the counterpart housing 50, pressing against the lock protrusion 24 by the interfering portion 54 is released. As shown in FIG. 13, the lock arm 12 elastically returns, and the lock protrusion 24 is engaged to the inside of the lock receiver 52 from below. By so doing, the upper portion of the engaging surface 29 of the lock protrusion 24 is arranged so as to be engageable to the engagement receiving surface 53 of the lock receiver 52, and the housings 10 and 50 are held so as to be engageable to each other.

As shown in FIG. 13, when the housing main body 11 is engaged to the counterpart housing 50, the auxiliary protrusion 91 on the top end surface of the protrusion 87 is pressed down by the pressing surface 56 of the interfering portion 54. At that time, the protrusion 87 maintains the contact with the interfering portion 54 without following a reciprocative displacement of the lock arm 12, and the contact portion 93 slips out from the accommodating concave portion 31. By so doing, the detecting member 70 is kept at a waiting position at which it contacts the counterpart housing 50 as the elastic arm portion 72 is released from the lock arm 12. At the waiting position, the elastic arm portion 72 is bent and deformed by the interfering portion 54 such that an inclined posture close to horizontal is obtained.

As shown in FIG. 13, in a state in which the detecting member 70 is at the waiting position, the moderately inclined surface 92 of the protrusion 87 and is arranged facing the top end opening periphery 31E of the accommodating concave portion 31 at the rear surface the lock protrusion 24 from behind, with a slight gap between the moderately inclined surface 92 and the top end opening periphery 31E. Specifically, it is arranged such that the top end opening periphery 31E of the accommodating concave portion 31 is housed within a range of a height of the moderately inclined surface 92 of the protrusion 87.

After the housing main body 11 is engaged to the counterpart housing 50, by pressing the rear surface of the rear portion 73 of the detecting member 70 forward, the detecting member 70 is moved forward to the detecting position. When a forward pressing force is applied to the detecting member 70 at the waiting position, a half-lock state of the temporary engaging portion 85 and the restriction portion 23 is released, and the elastic piece 94 is bent and deformed, and rides over the restriction portion 23. Additionally, as shown in FIG. 14, in a process in which the detecting member 70 moves forward to the detecting position, the moderately inclined surface 92 of the protrusion 87 slidably contacts the top end opening periphery 31E of the accommodating concave portion 31. In this slidable contact process, the angle of inclination of the moderately inclined surface 92 in the front-to-back direction is smaller than that of the steeply inclined surface 88. Thus, resistance due to slidable contact is minimized. Because of the slidable contact of the moderately inclined surface 92 and the top end opening periphery 31E of the accommodating concave portion 31, the elastic arm portion 72 is significantly bent and deformed and deeply inserted into the bending space 25. Furthermore, the protrusion 87 is inserted into the accommodating concave portion 31 from behind.

As shown in FIG. 15, when the detecting member 70 reaches the detecting position, substantially the entire protrusion 87 is engaged to and housed in the accommodating concave portion 31. In the same manner, the auxiliary protrusion 91 is also engaged to and housed in the auxiliary concave portion 32. As the protrusion 87 contacts the inside front surface of the accommodating concave portion 31, the detecting member 70 is restricted from moving further forward. Additionally, as shown in FIG. 18, at the detecting position, as the elastic piece 84 elastically returns, and the temporary engaging portion 85 contacts the restriction portion 23 from in front, moving backward of the detecting member 70 is restricted. Thus, the detecting member 70 is kept at the detecting position.

Figure 20:
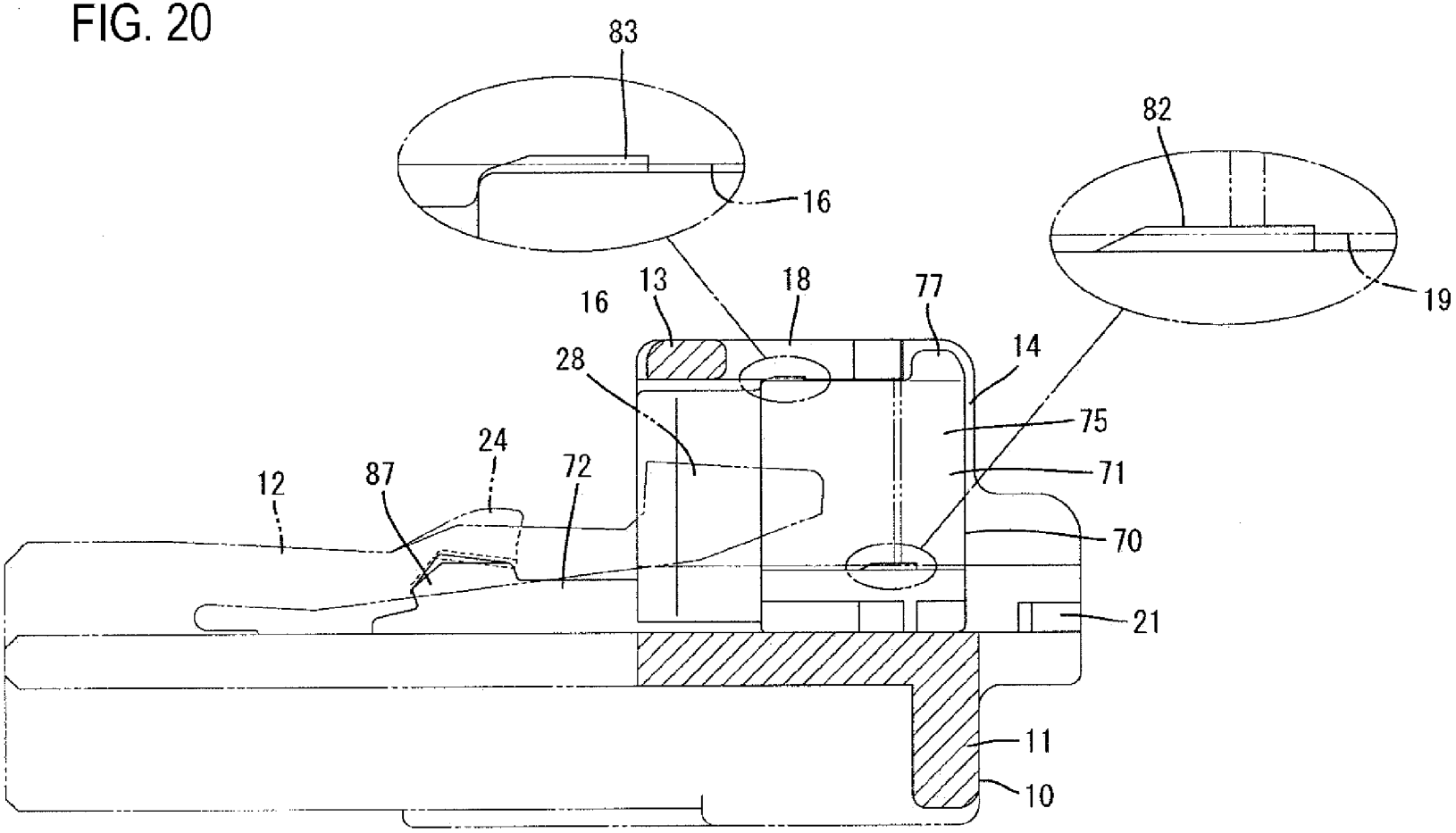
FIG. 20 is a side view of a main portion showing a state in which the detecting member is assembled to the housing main body and rattling of the main body portion is suppressed by first and second rattle restriction portions.

Additionally, as shown in FIG. 15, at the detecting position, the elastic arm portion 72 is held at a substantially horizontal posture while an elastic force between the lock arm 12 and the housing main body 11 is stored. Furthermore, the elastic arm portion 72 is inserted into the bending space 25, and then the bending operation of the lock arm 12 is restricted. Thus, engagement of the housings 10 and 50 is firmly held. Furthermore, in a process in which the detecting member 70 is moving toward the detecting position from the initial position via the waiting position, the first rattle restriction portion 82 slidably contacts the inside top surface of the guide groove 19, and the second rattle restriction portion 83 slidably contacts the lower surface of the bridge portion 16 in a pressed state. Thus, the main body portion 71 can be suppressed from falling down, and stability of a posture at which the detecting member 70 moves is ensured. Furthermore, as shown in FIGS. 2 and 20, at the respective initial, waiting, and detecting positions, rattling of the main body portion 71 is controlled by an operation of the first and second rattle restriction portions 82 and 83, respectively, and the detecting member 70 is held so as to be positioned at the housing main body 11.

Meanwhile, as shown in FIG. 12, if the housing main body 11 and the counterpart housing 50 are not engaged to each other and are kept at a halfway engaged position, the lock arm 12 is pressed against the pressing surface 56 of the interfering portion 54, and is bent and deformed in the bending space 25 as-is. Thus, even if the detecting member 70 is pressed forward in this state, the protrusion 87 interferes with the lock protrusion 24, and the elastic arm portion 72 cannot enter the bending space 25, and movement of the detecting member 70 to the detecting position can be prevented. Thus, depending on whether the detecting member 70 can move to the detecting position, it is possible to find out whether the housing main body 11 and the counterpart housing 50 are engaged to each other.

Additionally, when the housings 10 and 50 are separated, which are held in a normal engagement state, first, a finger or a jig is applied to the hook portions 77. In that state, the detecting member 70 is pulled rearward. When a tensile force acts on the detecting member 70 rearward, engagement of the temporary engagement portion 85 and the restriction portion 23 is released along with a bending operation of the elastic piece 84. Thus, the detecting member 70 is pulled back to the initial position.

Then, a finger or a jig is inserted into the releasing operation window 74 from behind, and a finger or a jig is applied to the top surface of the releasing operation portion 28, and the releasing operation portion 28 is pressed down (direction in which locking is released) for operation. At that time, the bridge portion 16 is arranged above the releasing operation portion 28. However, in the notch portion 18, the rear end side area (the rear end side area of the first operating portions 28A or the rear end portion of the second operating portion 28B) of the releasing operation portion 28 is exposed upward. Thus, the releasing operation portion 28 can be pressed and operated in a direction in which the locking is released.

When the locking is released in the releasing operation portion 28, the lock arm 12 is elastically bent downward, the lock protrusion 24 is released and separated from the lock receiver 52, and engagement of the lock arm 12 and the lock receiver 52 is released. Subsequently, while the releasing operation portion 28 is being pressed down, by separating the housing main body 11 from the counterpart housing 50, the housings 10 and 50 are separated from each other.

Thus, according to this embodiment 1, the following effects can be achieved. The connector of this embodiment 1extends rearward in a cantilever shape from the top surface of the housing main body 11, can be bent and deformed in a vertical direction crossing a direction in which the housing main body 11 and the counterpart housing 50 are engaged to each other, and is provided with: (i) the lock arm 12 that holds the housing main body 11 and the counterpart housing 50 in a normal engagement state by elastically engaging with the lock receiver 52, and (ii) a detecting member 70 that is assembled to the top surface of the housing main body 11 and is moved toward a detecting position from an initial position when the housing main body 11 is engaged to the counterpart housing 50.

On the detecting member 70, the elastic arm portion 72 is formed extending in a cantilevered state diagonally upward and forward and can be bent and deformed in a vertical direction. At an extended end portion (front end portion) of the elastic arm portion 72, the abutting portion 94 is formed, which restricts the movement of the detecting member 70 from the initial position to the detecting position by engaging to the engaging surface 29 of the lock arm 12 from behind and releases the engagement of the lock arm 12 when the housing main body 11 is engaged to the counterpart housing 50. At the extended end portion of the elastic arm portion 72, the contact portion 93 is formed, which restricts the abutting portion 94 engaged to the lock arm 12 from slipping off upward (side opposite to the bending space 25) by contacting the inside top surface of the accommodating concave portion 31 of the lock arm 12 from below (the bending space 25 side).

Thus, the contact portion 93 contacts the lock arm 12 from below, so while the housing main body 11 is not engaged to the counterpart housing 50 and the detecting member 70 is at the initial position, if the detecting member 70 is improperly pressed and moved forward, the front end portion of the elastic arm portion 72 pushes the lock arm 12 upward (that is, a direction opposite to a direction of original elastic bending of the lock arm 12). If the lock arm 12 is excessively pushed up, the abutting portion 94 slips off from the engaging surface 29. As a result, the elastic arm portion 72 slips under the lock arm 12 and is improperly pushed toward the detecting position side.

Figure 21:
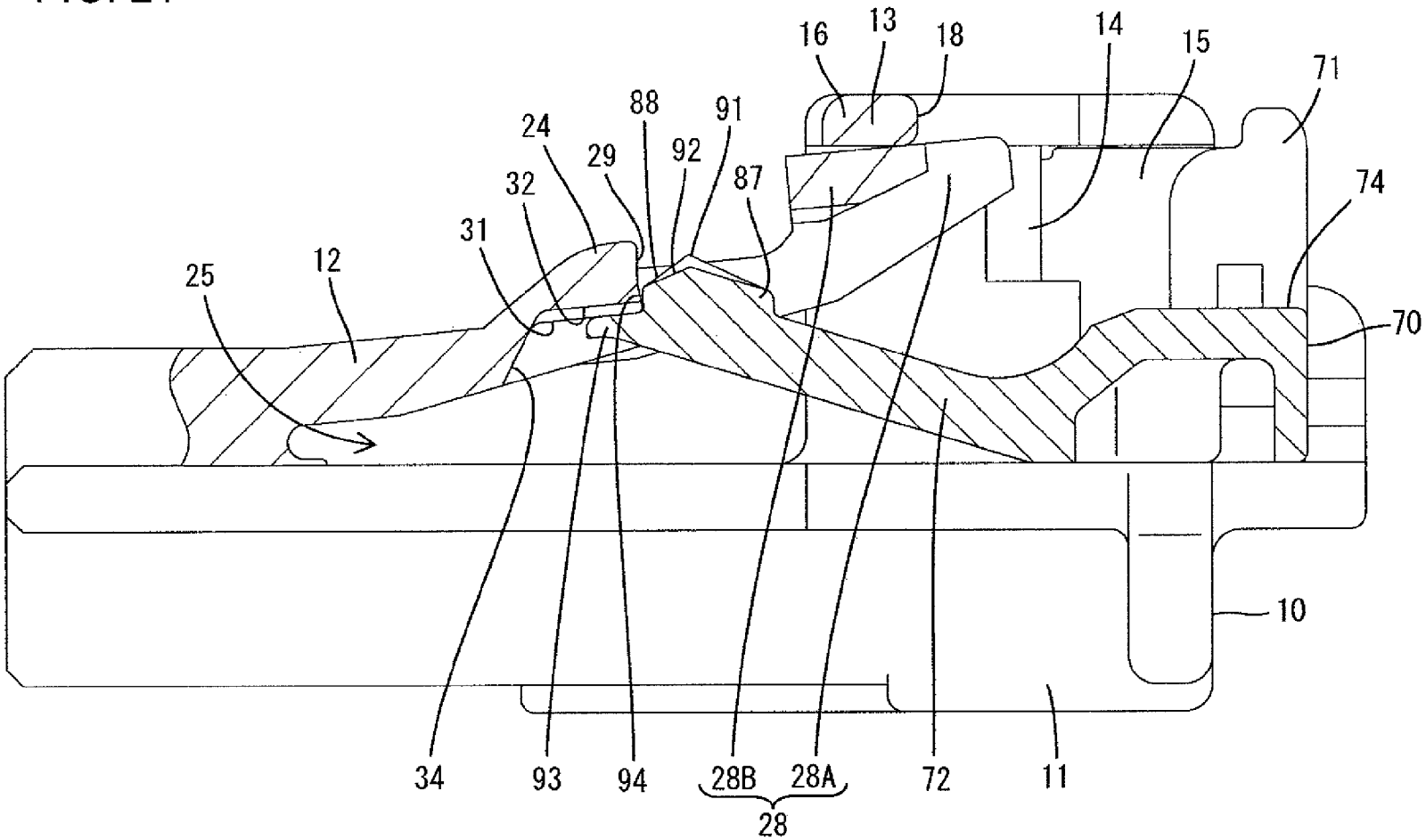
FIG. 21 is a cross-sectional view of a main body showing a state in which excessive bending of the lock arm pushed up by an elastic arm portion is restricted by an excessive bending restriction portion.

However, the connector of this embodiment 1is provided with: (i) pairs of walls (outside walls 14, inside walls 15) at the right and left that are raised from the top surface of the housing main body 11, and (ii) the bridge portion 16 that connects top ends of these walls (outside walls 14, inside walls 15). The bridge portion 16 is arranged so as to cover the top surface of the releasing operation portion 28 of the lock arm 12. Thus, as shown in FIG. 21, even if the lock arm 12 is pushed up, the top surface of the releasing operation portion 28 contacts the bridge portion 16 from below, and due to this contact effect, further upward movement of the lock arm 12 is restricted. Because of this configuration, the detecting member 70 can be suppressed from being improperly pushed into the detecting position. Furthermore, the lock arm 12 can be impeded or suppressed from being excessively bent beyond the elastic limitation.

Additionally, in this embodiment 1, the right and left end portions of the bridge portion 16 are supported by pairs of walls (outside walls 14, inside walls 15) raised from the housing main body 11. Thus, they do not succumb to a pressure force from the lock arm 12 side and become deformed so as to be curved upward. Thus, according to this embodiment 1, it is possible to reliably restrict the lock arm 12 from being pushed up, and it is possible to reliably suppress or impede the detecting member 70 from being improperly moved to the detecting position. Thus, reliability of a function of detecting engagement by using the detecting member 70 is excellent.

Furthermore, in the connector of this embodiment 1, two pairs of walls (outside walls 14, inside walls 15) that support the right and left end portions of the bridge portion 16 are aligned in a right-to-left direction (that is, gaps are formed at the right and left sides), and the bridge portion 16 is continuous with the top end portions of the two pairs of walls (outside walls 14, inside walls 15). Thus, the right and left end portions of the bridge portion 16 are supported at two places in which gaps are formed on the right and left sides, so curvature and deformation in which the center portion of the bridge portion 16 is lifted upward can be reliably reduced or suppressed.

Additionally, in the connector of this embodiment 1, at the rear end portion of the lock arm 12, the releasing operation portion 28 is formed, which is pressed down and operated when engagement with the lock receiver 52 is released, and this releasing operation portion 28 contacts the bridge portion 16. However, the bridge portion 16 only covers the front end side area of the top surface of the releasing operation portion 28. Thus, the rear end side area of the releasing operation portion 28 does not correspond to the bridge portion 16 and is exposed upward. Thus, when the lock of the releasing operation portion 28 is released, the bridge portion 16 does not prevent the operation.

Additionally, when the detecting member 70 is at an initial position, the elastic arm portion 72 contacts the lock arm 12 from a height direction and applies a pre-load. Accordingly, the elastic arm portion 72 is arranged at a position so as to be able to contact the lock arm 12 from behind, and the amount that it overlaps the lock arm 12 is appropriately determined. Thus, even if a dimension of the detecting member 70 is not strictly managed, detection reliability can be improved.

Here, when the detecting member 70 is at the waiting position, the protrusion 87 of the elastic arm portion 72 is arranged at a position so as to overlap the lock arm 12 in a height direction, and the moderately inclined surface 92 of the protrusion 87 slidably contacts the lock arm 12 in a process in which it is moved from the waiting position to the detecting position. Thus, accuracy of position precision of the protrusion 87 at the waiting position is required. With respect to this point, according to this embodiment 1, the elastic arm portion 72 contacts the lock arm 12 at the initial position from a height direction, so position accuracy of the protrusion 87 can be satisfied.

Additionally, the main body portion 71 is provided in which the detecting member 70 is pressed down when it moves to the detecting position, the main body portion 71 slidably contacts the housing main body 11 in a process in which the detecting member 70 moves, and among both slidable contact surfaces of the main body portion 71 and the housing main body 11, on the slidable movement surface of the main body portion 71, the first rattle restriction portion 82 and the second rattle restriction portion 83 are arranged which are pressed against the slidable movement surface of the housing main body 11 in a height direction. Thus, rattling of the detecting member 70 can be suppressed in a height direction. As a result, detection reliability of the detecting member 70 is further enhanced.

Furthermore, the first rattle restriction portion 82 and the second rattle restriction portion 83 are arranged at the main body portion 71 in a front-to-back direction, and two rattle restriction portions are aligned in a height direction. Thus, the detecting member 70 is impeded or suppressed from being inclined in the front-to-back direction, and stability of a posture of the detecting member 70 is secured.

Additionally, when the detecting member 70 reaches the detecting position, the protrusion 87 is housed in the accommodating concave portion 31 of the lock arm 12, so it is arranged at a position in which the lock arm 12 and the detecting member 70 overlap each other in a height direction, and the height of the connector can be reduced. In this case, the accommodating concave portion 31 is open rearward and to the bending space 25 side of the lock arm 12, but is not open to the front end portion continuous to the housing main body 11. Thus, strength of the lock arm 12 is suppressed from deteriorating. As a result, reliability of the locking by the lock arm 12 is enhanced.

Furthermore, the lock protrusion 24 is formed protruding on the lock arm 12 in a height direction, and the accommodating concave portion 31 is open to the rear surface of the lock protrusion 24. Thus, the opening area of the accommodating concave portion 31 can be significantly secured in a height direction within a range of the height of the lock protrusion 24. Additionally, when the detecting member 70 is at the waiting position, the protrusion 87 and the lock protrusion 24 are arranged at a position so as to overlap each other in a height direction. Thus, the height of the connector can be further lowered.

Additionally, in a process in which the detecting member 70 reaches the detecting position from the waiting position, because the moderately inclined surface 92 of the protrusion 87 slidably contacts the top end opening periphery 31E of the accommodating concave portion 31, an operation is guided in which the protrusion 87 is inserted into the accommodating concave portion 31. Thus, stability of the operation of moving the detecting member 70 is secured.

Furthermore, not only the protrusion 87, but also the accommodating concave portion 31 are inserted into the auxiliary protrusion 91, and there is a concern that the depth of the accommodating concave portion 31 also increases by the same amount as the height of the auxiliary protrusion 91, and the strength of the lock arm 12 may deteriorate. However, according to this embodiment 1, on part of the inside top surface of the accommodating concave portion 31, only the auxiliary concave portion 32, which is engaged to the auxiliary protrusion 91 at the detecting position, is formed to be concave. Thus, the strength of the lock arm 12 can be suppressed from deteriorating without increasing the depth of the entire accommodating concave portion 31.

Additionally, the surface opposite to the surface facing the bending space 25 of the releasing operation portion 28 is partially covered by the bridge portion 16 of the protective wall 13. Thus, the protective wall 13 restricts an inadvertent releasing operation of the releasing operation portions 28. Additionally, meanwhile, when engagement with the lock arm 12 is released, a finger or a jig is applied to the releasing operation portions 28 via the releasing operation window 74 that is open to the rear portion 73 of the detecting member 70, such that a releasing operation can be performed. Furthermore, on the bridge portion 16, the notch portion 18 is formed that opens part of the top surface of the releasing operation portion 28 upward. Thus, an operation of releasing engagement of the lock arm 12 is easily performed.

Additionally, when the counterpart housing 50 is separated from the housing main body 11, a finger or a jig is applied to the hook portions 77 of the rear portion 73, and the detecting member 70 is pulled back to an initial position side. Then, an operation of releasing the locking of the releasing operation portion 28 is performed. In this case, a pair of the hook portions 77 is arranged on both sides that sandwich the releasing operation window 74 of the rear portion 73. Thus, space efficiency of the rear portion 73 becomes preferable and it is possible to make a connector smaller.

This invention is not limited to embodiments explained in the above-mentioned description and drawings, but at least the following embodiments are also included within the technical range of this invention.

(1) A structure is also acceptable in which, when the detecting member reaches the detecting position, the detecting member cannot restrict a bending operation of the lock arm.

(2) It is acceptable for the protrusion of the accommodating concave portion not to be formed in size and shape size and shape that matches that of the protrusion of the detecting member. It may also be formed at a size at which it loosely engages the protrusion.

(3) The accommodating concave portion may open rearward at a portion other than the lock protrusion of the lock arm.

(4) The rattle restriction portion may be formed in the housing main body, and not be formed in the main body portion. Furthermore, rattle restriction portions may be formed on both the main body portion and the housing body portion.

(5) A plurality of rattle restriction portions may be arranged on the same axis in a back-to-front direction and a height direction.

(6) Three or more rattle restriction portions may be arranged in a back-to-front direction and a height direction.

(7) A plurality of auxiliary protrusions may be formed at a top end of the protrusion. For example, a pair of auxiliary protrusions may be formed on both sides, in a width direction, of a top end of the protrusion. In this case, in the accommodating concave portion, at positions corresponding to the auxiliary protrusions, a plurality of auxiliary concave portions may be formed.

(8) The guide surface and the guide inclined surface may also be formed as curved inclined surfaces.

(9) In the above-mentioned embodiments, two pairs of walls support the right and left end portions of the bridge portion, but one pair of walls may support the right and left end portions of the bridge portion.

(10) In the above-mentioned embodiments, the bridge portion covers the top surface of the releasing operation portion, but the bridge portion may cover an area other than the releasing operation portion of the top surface of the lock arm.

(11) In the above-mentioned embodiments, the bridge portion covers only the front end side area of the releasing operation portion, but the bridge portion may cover only the rear end side area of the releasing operation portion or cover only the center portion of the releasing operation portion in the front-to-back direction.

What is claimed is:

1. A connector, comprising:

a counterpart housing having a lock receiver;

a housing main body that is engageable to the counterpart housing, the housing main body defining a top surface;

a lock arm that extends rearward in a cantilever shape from the top surface of the housing main body, can be bent and deformed in a vertical direction crossing a direction of engagement of the housing main body and the counterpart housing, and holds the housing main body and the counterpart housing in a normal engagement state by being elastically engaged to the lock receiver;

a releasing operation portion formed at a rear end portion of the lock arm, which performs a downward pressing operation if engagement of the lock receiver is released;

a detecting member that is assembled to the top surface of the housing main body and is moved from an initial position to a detecting position in which the detecting member is fully inserted into the housing main body when the housing main body and the counterpart housing are engaged to each other;

an elastic arm portion that is formed on the detecting member, extends in a cantilever shape diagonally upward and forward, and can be bent and deformed in a vertical direction;

a pair of side arm portions formed on the detecting member on either side of the elastic arm portion;

an abutting portion that is formed at an extended end portion of the elastic arm portion, restricts the movement of the detecting member from the initial position to the detecting position by engaging the lock arm from behind, and releases engagement of the lock arm if the housing main body and the counterpart housing are engaged to each other;

an upward protrusion that is formed at the extended end portion of the elastic arm portion;

a contact portion that is formed on a top surface of the upward protrusion, and restricts the contact portion from slipping off upward from engagement of the lock arm by contacting the lock arm from below and engaging a concave portion of the lock arm in the detecting position; and an excessive bending restriction portion that includes: (i) an inner pair and an outer pair of side walls that are raised from the top surface of the housing main body, (ii) a bridge portion that interconnects top ends of each of the walls, restricts excessive bending of the lock arm upward by covering a front portion of a top surface of the releasing operation portion, and leaves a rear portion of the top surface upwardly exposed, (iii) a central passageway formed between the inner pair of side walls in which the elastic arm portion is disposed in the detecting position, (iv) a pair of side passageways formed on either side of the central passageway in which the side arm portions are disposed in the detecting position, each formed between an inner side wall and an outer side wall, and (v) restriction portions on the inner side walls that protrude away from the lock arm into the side passageways and are engaged by the side arm portions, wherein the detecting member only secures the lock arm at the contact portion.

2. The connector of claim 1, wherein the lock arm defines a lock protrusion with an engaging surface that contacts the abutting portion of the elastic arm portion to restrict movement of the detecting member from the initial position to the detecting position.

3. The connector of claim 2, wherein the contact portion engages a lower surface of the lock protrusion to restrict the contact portion from slipping off upward from engagement of the lock arm.

4. The connector of claim 3, wherein the housing main body defines a bottom base member, and a bending space is defined between the lock arm and the bottom base member.

* * * * *